US007404450B2

(12) United States Patent
Izumisawa et al.

(10) Patent No.: US 7,404,450 B2
(45) Date of Patent: Jul. 29, 2008

(54) PNEUMATIC ROTARY TOOL

(75) Inventors: Osamu Izumisawa, Tokyo (JP); Kunihiro Yamamoto, Tokyo (JP)

(73) Assignee: S.P. Air Kabusiki Kaisha, Nagano Pref (JP)

( * ) Notice: Subject to any disclaimer, the term of this patent is extended or adjusted under 35 U.S.C. 154(b) by 102 days.

(21) Appl. No.: 10/182,167

(22) PCT Filed: Jan. 26, 2001

(86) PCT No.: PCT/US01/02785

§ 371 (c)(1),
(2), (4) Date: Nov. 8, 2002

(87) PCT Pub. No.: WO01/54865

PCT Pub. Date: Aug. 2, 2001

(65) Prior Publication Data

US 2003/0121680 A1 Jul. 3, 2003

Related U.S. Application Data

(63) Continuation-in-part of application No. 09/490,896, filed on Jan. 27, 2000, now Pat. No. 6,158,528.

(60) Provisional application No. 60/239,754, filed on Oct. 12, 2000, provisional application No. 60/233,550, filed on Sep. 19, 2000, provisional application No. 60/231,013, filed on Sep. 8, 2000.

(51) Int. Cl.
*B25D 9/00* (2006.01)
*B25D 15/00* (2006.01)
*B25D 9/14* (2006.01)

(52) U.S. Cl. ..... 173/93.5; 173/93; 173/104; 173/109

(58) Field of Classification Search ..... 173/93.5, 173/93, 104, 109, 218, 221; 81/467, 470; 16/406, 421, 430, 431
See application file for complete search history.

(56) References Cited

U.S. PATENT DOCUMENTS 2,331,874 A 10/1943 Van Sittert (Continued)

FOREIGN PATENT DOCUMENTS

CN 1205931 1/1999

(Continued)

OTHER PUBLICATIONS

Ingersoll-Rand, Model 55P3, IR Industrial Tools E-Catalog, viewed Jan. 4, 2000, dev2opcenter.net/irecatalo...&ModelNumber=55p3 &ReportType=Group, 1 page.

(Continued)

*Primary Examiner*—Brian D. Nash
*Assistant Examiner*—Nathaniel Chukwurah
(74) *Attorney, Agent, or Firm*—Senniger Powers LLP

(57) ABSTRACT

A pneumatic rotary tool has a housing formed primarily from plastic so that the weight and price of the tool are substantially reduced. The air motor is formed for economic assembly while permitting greater structural stability should the housing deflect under an impact. The tool includes a torque selector which controls the amount of pressurized air allowed to enter the air motor, thereby controlling the torque output of the motor. The user may adjust the torque selector to a number of set positions which correspond to discrete torque values. The tool additionally incorporates early and late stage exhaust ports, so that backpressure within the air motor does not slow motor rotation or decrease tool power.

36 Claims, 17 Drawing Sheets

U.S. PATENT DOCUMENTS

| | | | | | |
|---|---|---|---|---|---|
| 2,569,244 | A | | 9/1951 | Larson | |
| 2,581,033 | A | | 1/1952 | Larson et al. | |
| 2,715,889 | A | | 8/1955 | Sturrock | |
| 3,270,834 | A | | 9/1966 | Bratt | |
| 3,432,703 | A | * | 3/1969 | Sheps et al. | 310/50 |
| 3,443,646 | A | | 5/1969 | Baker et al. | |
| 3,714,994 | A | | 2/1973 | Zoerner et al. | |
| 3,827,834 | A | | 8/1974 | Kakimoto | |
| 3,835,934 | A | * | 9/1974 | Schoeps et al. | 173/176 |
| 4,379,492 | A | | 4/1983 | Hiraoko | |
| 4,440,238 | A | * | 4/1984 | Sauerwein et al. | 173/170 |
| 4,580,435 | A | * | 4/1986 | Port et al. | 29/243.525 |
| 4,631,012 | A | | 12/1986 | Eckman | |
| 4,839,995 | A | | 6/1989 | Hutchins | |
| 5,020,607 | A | | 6/1991 | Sentivan | |
| 5,083,619 | A | * | 1/1992 | Giardino et al. | 173/93 |
| 5,110,030 | A | | 5/1992 | Tanji | |
| 5,131,579 | A | | 7/1992 | Okushima et al. | |
| 5,199,505 | A | | 4/1993 | Izumisawa | |
| D339,726 | S | | 9/1993 | Bruno et al. | |
| 5,292,352 | A | | 3/1994 | Rudolf et al. | |
| 5,293,747 | A | | 3/1994 | Geiger | |
| 5,330,106 | A | | 7/1994 | Braun, Jr. | |
| 5,346,024 | A | | 9/1994 | Geiger et al. | |
| 5,377,769 | A | | 1/1995 | Hasuo et al. | |
| 5,383,771 | A | | 1/1995 | Ghode et al. | |
| 5,417,294 | A | | 5/1995 | Suher | |
| 5,441,450 | A | | 8/1995 | Fein et al. | |
| 5,535,646 | A | | 7/1996 | Allen et al. | |
| 5,535,867 | A | | 7/1996 | Coccaro et al. | |
| 5,591,070 | A | | 1/1997 | Kachich | |
| 5,738,177 | A | | 4/1998 | Schell et al. | |
| 5,765,652 | A | | 6/1998 | Mathis | |
| 5,767,652 | A | | 6/1998 | Mathis et al. | |
| 5,784,934 | A | | 7/1998 | Izumisawa | |
| D408,243 | S | | 4/1999 | Izumisawa | |
| 5,901,794 | A | | 5/1999 | Schoeps et al. | |
| 5,906,244 | A | | 5/1999 | Thompson et al. | |
| 5,918,686 | A | * | 7/1999 | Izumisawa | 173/20 |
| 5,992,539 | A | | 11/1999 | Lin | |
| 5,992,540 | A | * | 11/1999 | Smolinski et al. | 173/169 |
| 6,082,468 | A | * | 7/2000 | Pusateri et al. | 173/170 |
| 6,179,063 | B1 | * | 1/2001 | Borries et al. | 173/93.5 |
| 6,308,378 | B1 | * | 10/2001 | Mooty et al. | 16/430 |
| 6,443,239 | B1 | | 9/2002 | Izumisawa | |
| 6,612,476 | B2 | * | 9/2003 | Smolinski | 227/120 |
| 6,719,067 | B2 | * | 4/2004 | Taga | 173/93.5 |
| 6,721,997 | B2 | * | 4/2004 | Hua | 16/431 |
| 6,796,386 | B2 | * | 9/2004 | Izumisawa et al. | 173/93.5 |

FOREIGN PATENT DOCUMENTS

| | | | |
|---|---|---|---|
| CN | 2081886 | | 7/1999 |
| DE | 33 30 891 | A1 | 3/1985 |
| EP | 0 372 376 | | 6/1990 |
| EP | 0576186 | A1 | 12/1993 |
| EP | 0 849 052 | A2 | 6/1998 |
| EP | 0 876 883 | A2 | 11/1998 |
| EP | 0 885 658 | A2 | 12/1998 |
| FR | 2097803 | | 3/1972 |
| GB | 811252 | | 4/1959 |
| GB | 1204718 | | 9/1970 |
| GB | 2 149 465 | | 6/1985 |
| JP | S47-17057 | | 5/1972 |
| JP | 6055461 | | 3/1994 |
| JP | 9070765 | | 3/1997 |
| JP | 10329050 | | 12/1998 |
| SU | 1306889 | A1 | 4/1987 |
| TW | 287457 | | 10/1996 |
| TW | 287458 | | 10/1996 |
| TW | 327849 | | 3/1998 |
| TW | 369981 | | 9/1999 |
| WO | 94/04312 | | 3/1994 |

OTHER PUBLICATIONS

Ingersoll-Rand, Model 100PQ1, IR Industrial Tools E-Catalog, viewed Jan. 4, 2000, dev2opcenter.net/irecatalo... &ModelNumber=100PQ&ReportType=Group, 1 page.

PCT/US01/02785 International Search Report from the European Patent Office dated Sep. 25, 2001,4 pages.

Japanese Office Action, Dated Mar. 1, 2005, 2 Pages.

Chinese Patent Office Notification of First Office Action for Application No. 200610005852.5 dated Nov. 16, 2007 (8 pages).

Chinese Patent Office Notification of First Office Action for Application No. 200610005850.6 dated Nov. 16, 2007 (4 pages).

US PTO Office Action for U.S. Appl. No. 11/624,003 dated Oct. 01, 2007 (18 pages).

Office action dated Oct. 19, 2007 regarding Chinese Application No. 200610005851.0, 3 pages.

* cited by examiner

PNEUMATIC ROTARY TOOL

BACKGROUND OF THE INVENTION

This invention generally relates to pneumatic rotary tools and more particularly to an improved pneumatic rotary tool having a plastic housing and a variable torque design for efficient use of pressurized air.

The invention is especially concerned with a powered tool that rotates an output shaft with a socket for turning a fastener element such as a bolt or nut. Tools of this type are frequently used in automotive repair and industrial applications. Conventionally, pneumatic rotary tools comprise a metallic outer housing with multiple metallic internal parts. These tools are strong and durable due to their metallic construction, although the all-metal construction makes them both somewhat heavy and costly. Pressurized air flowing through the tool powers tools of this type. As the air expands within the tool, it induces motion of an internal motor, powering the tool.

It is an aim of tool manufacturers to provide a pneumatic rotary tool that is as durable as an all-metal tool, but employs portions formed from lighter materials, such as plastic, where appropriate to reduce the weight and cost of the tool. One difficulty in the design of such a tool is the reduced rigidity of plastic as compared with a strong metal, such as steel. For instance, should a plastic tool fall against a hard surface, a metallic air motor inside the tool may shift and become misaligned, or canted, with respect to the housing and the output shaft, rendering the tool unusable. This problem has led tool manufacturers to create complex internal motor casings designed to inhibit the motor from canting in the housing. For example, U.S. Pat. No. 5,346,024 (Geiger et al.) discloses such a motor casing, described as a motor cylinder 15. This casing is cylindrical in shape, with one closed end that includes multiple parts, such as a back head 26 and bore 27, extending from the closed end. The cylinder, back head and bore are of unitary construction, making a closed end cylinder significantly more difficult to manufacture. Therefore, these casings are expensive to manufacture, which may mitigate the cost benefit of using lighter and less costly materials, such as plastic, for other parts. As such, a tool formed inexpensively from both lightweight material and metallic parts is desirable.

In addition, conventional rotary tools often incorporate mechanisms to regulate torque according to user input. One such tool uses back pressure within the air motor to regulate the torque output. As backpressure within the motor increases, the torque output of the motor decreases. Such a design is inefficient because it uses the maximum flow of pressurized air to power the tool, while operating below its maximum power. At lower torque settings, a large portion of air bypasses the motor for backpressuring the motor, adding no power to the tool. As such, a tool that can more efficiently regulate torque by using less pressurized air is needed. Moreover, a tool that can reduce backpressure in the motor will operate more efficiently, using less air for the same work.

Typically air motors incorporate a rotor having a plurality of vanes upon which the pressurized air can react, inducing rotation of the rotor. Pockets of pressurized air are received within compartments defined by adjacent vanes. Conventional rotary tools typically have a single exhaust port in the air motor for exhausting pressurized air from the motor. As each rotor compartment passes the exhaust port, much of the air within the compartment passes through the exhaust port and exits the motor. Any air remaining within the compartment after the compartment passes the exhaust port becomes trapped within the compartment. The volume of the compartment decreases as the compartment nears completion of a motor cycle, and the compartment must compress the air within the compartment for the rotor to continue to rotate. Compressing the air within the compartment (backpressure) reduces the rotational speed of the turning rotor. Backpressure reduces motor efficiency; thus, a pneumatic rotary tool that reduces backpressure losses within the air motor is desirable.

SUMMARY OF THE INVENTION

Among the several objects and features of the present invention may be noted the provision of a pneumatic rotary tool which weighs and costs less due to a primarily plastic housing; the provision of such a tool having a plastic housing which resists misalignment of internal components under impact; the provision of such a tool which is comfortable to grip; the provision of such a tool having a plastic housing which fixes components without fasteners; the provision of such a pneumatic rotary tool which regulates torque between four discrete levels adjustable by the user; the provision of such a pneumatic rotary tool which throttles pressurized air as it enters the tool to efficiently control torque output of the motor by reducing how much air enters the tool; and the provision such of a pneumatic rotary tool which reduces back pressure within the motor and increases motor efficiency.

Generally, a pneumatic rotary tool of the present invention comprises a housing supporting an output shaft for rotation about its longitudinal axis. The shaft projects from the housing for transmitting torque to an object. An air motor is disposed in the housing and connected to the output shaft for driving rotation of the output shaft. An air inlet supported by the housing is constructed for connection to a source of pressurized air. An air passage extends from the air inlet to the motor for delivering pressurized air to the motor to power the motor. An air exhaust supported by the housing exhausts air from the motor to outside the tool housing. The air motor comprises a cylindrical support sleeve having a first open end and a second open end, a rotor being rotatable within the support sleeve having a plurality of vanes which extend radially outwardly from the rotor when the rotor rotates, a first end cap attached to the first open end, and a second end cap attached to the second open end. The first and second end caps are formed separately from the support sleeve, engaging the support sleeve for supporting the support sleeve in the housing against canting with respect to the housing under forces experienced by the tool in use.

In another aspect of the present invention, a pneumatic rotary tool comprises a housing, an output shaft, an air motor, an air inlet, air passages and an air exhaust generally as set forth above. In addition, the tool comprises a torque selector supported by the housing in a location for regulating flow of air through the passage.

In still another aspect of the present invention, a rotary vane air motor comprises a cylindrical motor housing, a rotor, a first exhaust port and a second exhaust port. The rotor is rotatable within the motor housing, having a plurality of vanes which extend radially outwardly from the rotor when the rotor rotates to touch the inside of the motor housing. The vane being most forward in the direction of rotation being the leading vane and the vane immediately following being the trailing vane. Adjacent vanes create multiple cavities within the motor for receiving compressed air as the rotor rotates and the vanes pass before an inlet port. The compressed air pushes against the leading vane, causing the rotor to rotate. Cavities formed between each pair of adjacent vanes may be classified according to their position within the motor housing, such that when the valve rotates each cavity moves through a power stage, an exhaust stage and a recovery stage. An exhaust associated with the housing is arranged to permit primary and secondary exhaust to inhibit back pressure on the trailing vane in an exhaust and recovery stage.

In yet another aspect of the present invention, a pneumatic rotary tool comprises a housing, an output shaft, an air motor and an air inlet supported by the housing. The air inlet is constructed for connection to a source of pressurized air for delivering pressurized air to the motor to power the motor to drive the output shaft. The air inlet further comprises an inlet cylinder, through which air passes. The housing is molded around the exterior of the inlet cylinder and holds the inlet cylinder within the housing.

In another aspect of the present invention, a pneumatic rotary tool comprises a housing and a grip. The grip extends downwardly from the housing for allowing a user to grasp and hold the tool securely. The grip further comprises an outer layer of soft material formed to cushion and ease pressure on the user's hand and increase friction between the grip and the user.

In a final aspect of the present invention, a method of assembling a pneumatic rotary tool comprises the following steps. A first end cap is brought into engagement with an end of a support sleeve. A rotor and a plurality of vanes are located within the support sleeve. A second end cap is brought into engagement with an opposite end of the support sleeve so that the first and second end caps, rotor and vanes cooperate to form an air motor, which is inserted into a housing. A Maurer Mechanism casing is brought into engagement with the housing, an end cover is seated on the housing and a plurality of bolts are passed through the end cover and housing. These bolts are threaded into the Maurer Mechanism casing, wherein the bolts draw the end cover toward the housing and the housing toward the Maurer Mechanism casing so that the end caps and support sleeve of the air motor are compressed within the housing to fully seat the end caps onto the support sleeve so that the motor, housing and end cover cooperate to hold the air motor in proper alignment within the tool.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
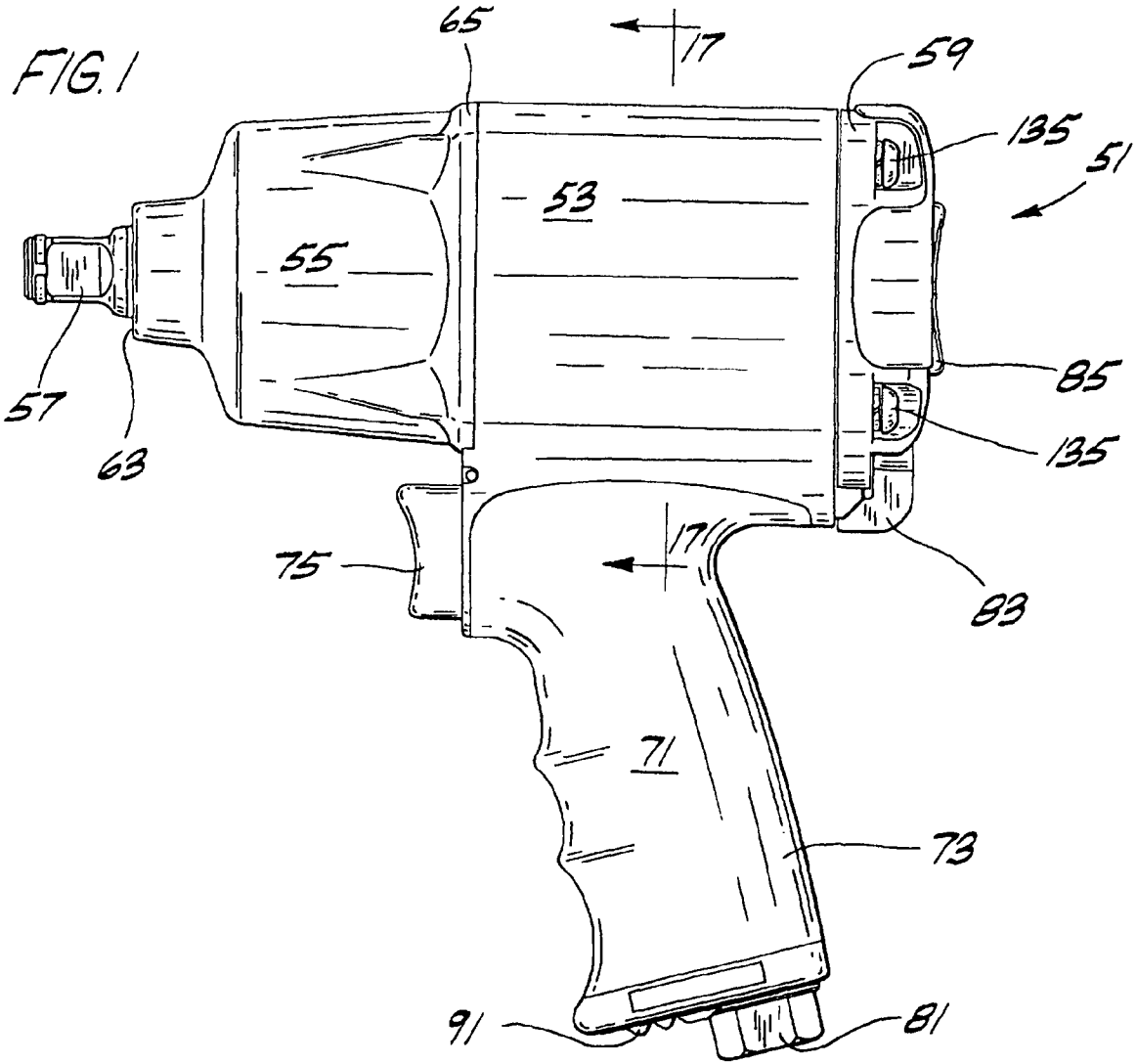
FIG. 1 is a side elevation of a pneumatic rotary tool of the present invention.

Referring now to the drawings and specifically to FIG. 1, a pneumatic rotary tool of the present invention is generally indicated at 51. The tool includes a housing 53, a Maurer Mechanism casing 55 at the front of the housing, an output shaft 57 and an end cover 59 mounted on the rear of the housing 53. The casing 55 may be considered part of the housing 53, due to the generally uniform interface between the housing and casing, which creates the appearance of one continuous profile when viewing the tool 51. The output shaft 57 extends from an front end 63 of the Maurer Mechanism casing 55. A back end 65 of the Maurer Mechanism casing 55 engages the housing 53. The tool 51 further comprises a grip 71 extending downwardly from the housing 53, allowing a user to grasp and hold the tool securely. The grip 71 has an additional outer layer 73 of soft material, such as rubber, to cushion and ease pressure on the user's hand, while increasing friction between the grip 71 and the user, making the tool 51 easier to hold. A trigger 75 extends from the front of the grip 71 for activating the tool 51. Furthermore, the tool 51 comprises an air inlet 81 for supplying pressurized air to the tool. The air inlet 81 mounts on the lower portion of the grip 71 and receives an air hose (not shown), as is conventional in the industry.

Figure 2:
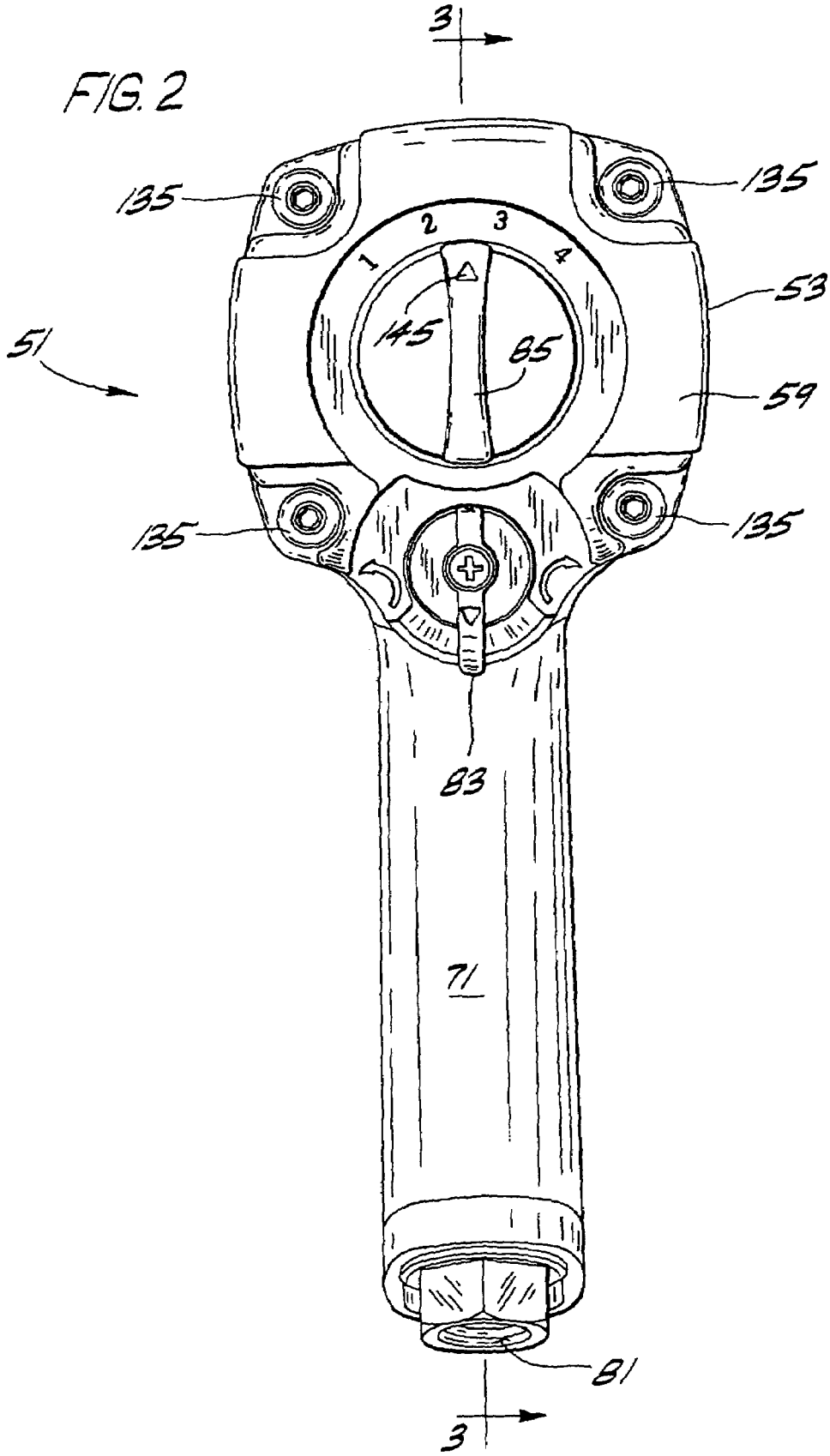
FIG. 2 is a rear elevation of the tool of FIG. 1.

Referring now to FIG. 2, the tool 51 additionally includes a rotation selector valve 83 mounted on the rear of the housing 53 for selecting the rotational direction of the output shaft 57. The rotation selector valve 83 is rotatable within the housing 53 and end cover 59 for altering a flow of compressed air within the tool 51 to control the direction of output shaft 57 rotation. A torque selector 85 mounted on the end cover 59 is rotatable within the end cover for controlling the torque of the tool 51 by throttling the flow of compressed air. In the illustrated embodiment, the torque selector 85 has four discrete positions corresponding to four torque settings. The functioning of the rotation selector valve 83 and the torque selector 85 will be discussed in greater detail below.

Figure 3:
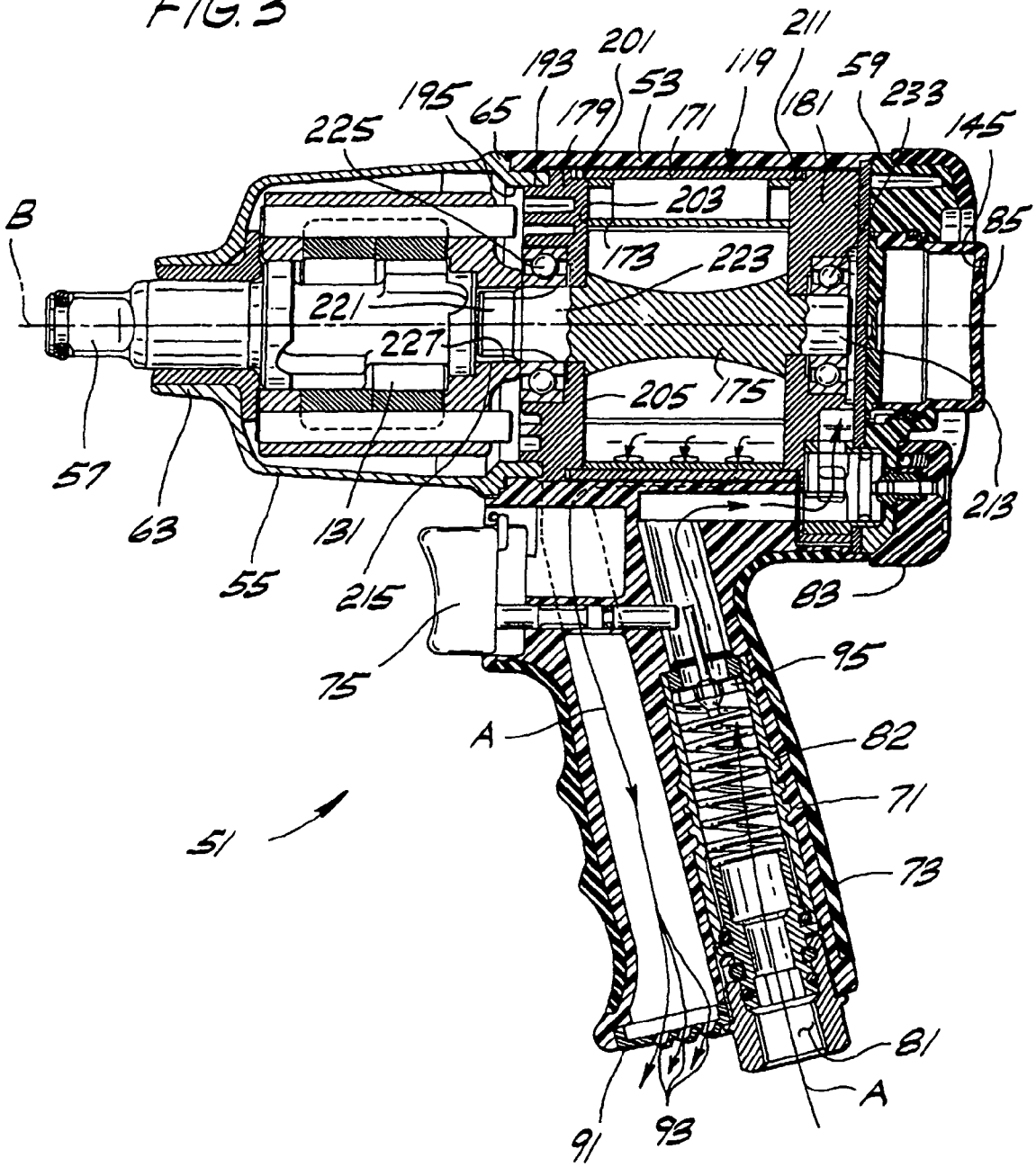
FIG. 3 is a section of the tool taken in a plane including line 3-3 of FIG. 2.
Figure 3A:
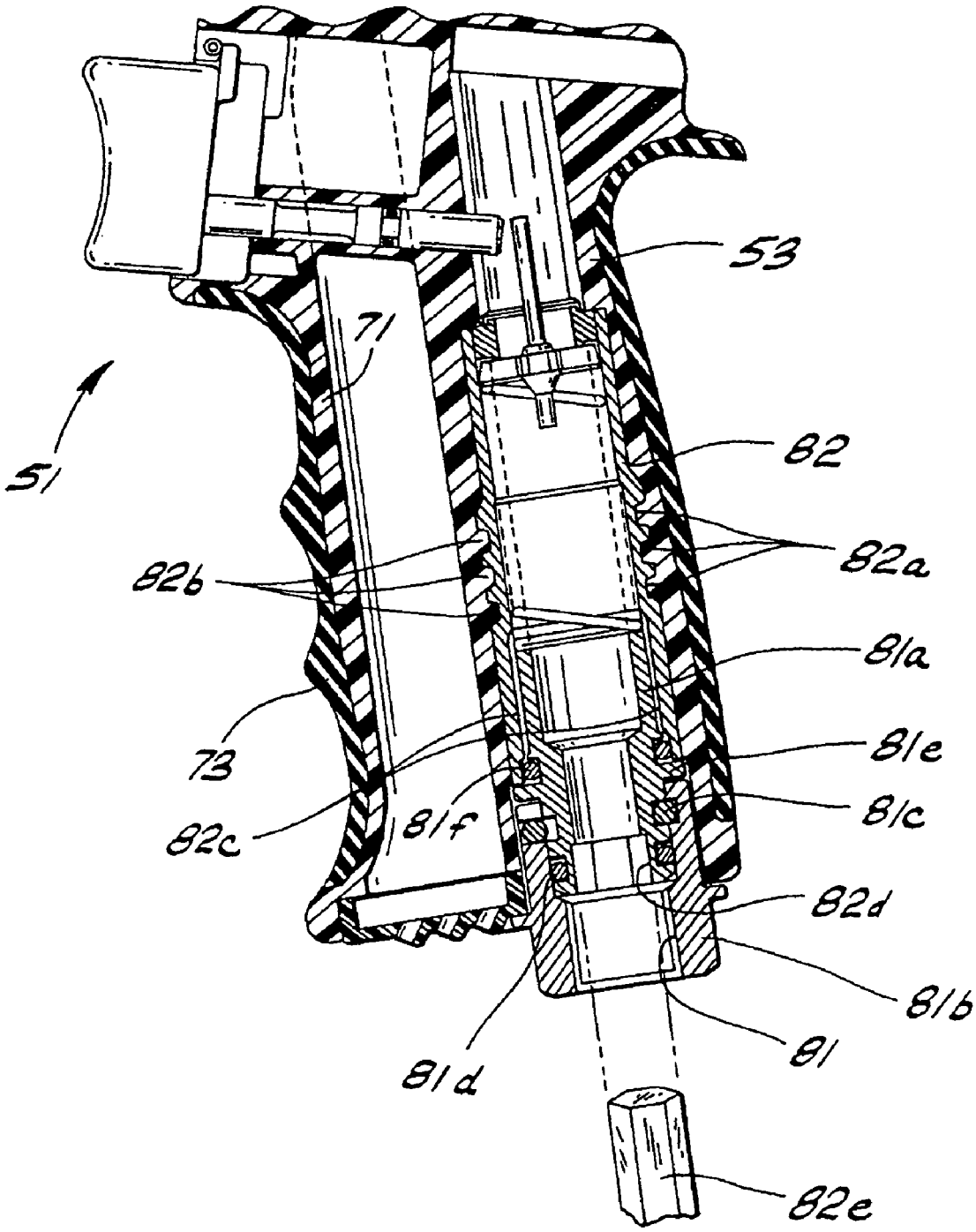
FIG. 3A is an enlarged, fragmentary section of the tool of FIG. 3 showing the grip.

Additionally, an air exhaust 91 mounts on the lower portion of the grip 71, adjacent the air inlet 81 (FIG. 3). The air exhaust 91 includes a plurality of small holes 93 for diffusing exhaust air as it exits the tool 51, directing exhaust air away from the user and preventing foreign objects from entering the air exhaust.

Figure 3C:
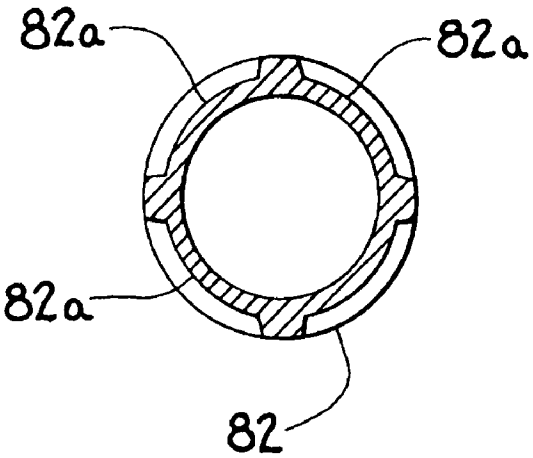
FIG. 3C is a section of the inlet cylinder taken in a plane including line 3C-3C of FIG. 3B.
Figure 3B:
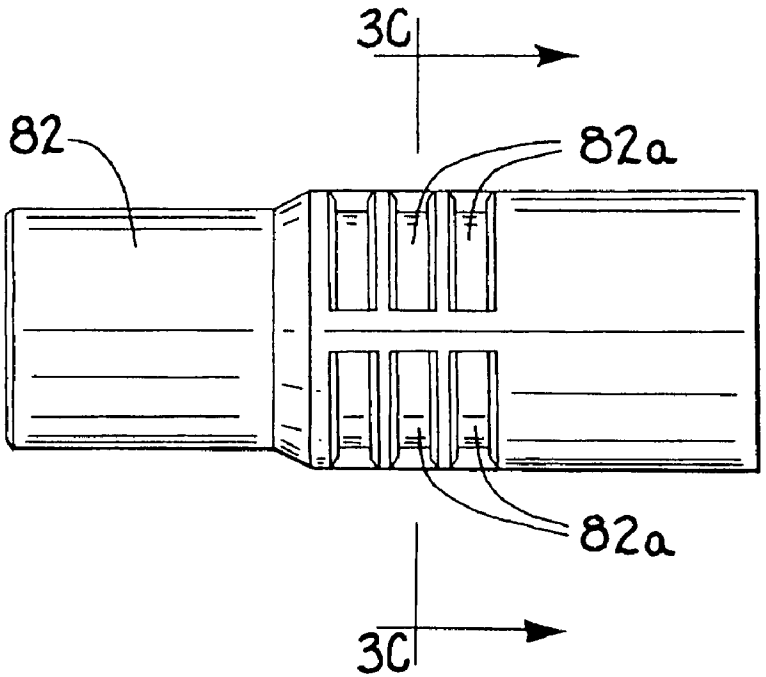
FIG. 3B is a side elevation of an inlet cylinder.

Turning to the interior workings of the tool 51, FIG. 3 discloses a side section of the tool. Air flow through the tool 51 is generally indicated by line A. Following the path of line A, pressurized air first enters the tool 51 through the air inlet 81. The air inlet 81 comprises a fitting 81*a*, a swivel connector 81*b* and an air inlet cylinder 82 through which air passes (FIGS. 3-3C). The plastic housing 53 is formed by a molding process in which plastic in a flowable form surrounds and engages the exterior of the inlet cylinder 82. The inlet cylinder includes annular grooves 82*a* into which the plastic flows when the housing 53 is formed. When the plastic hardens, the material in the grooves 82*a* forms protrusions 82*b* engaging the air inlet cylinder 82 in the grooves to secure the air inlet 81 in the housing. The housing 53 sufficiently encases the inlet cylinder 82 so that no fastening devices are necessary for holding the inlet cylinder within the housing.

The preferred molding process for forming the housing 53 around the air inlet cylinder 82 is a plastic injection molding process that is well known in the relevant art and described in further detail below.

The fitting 81*a* mounts the swivel connector 81*b* for pivoting of the swivel connector about the axis of the air inlet 81 via a snap ring 81*c*. Other mounting methods other that a snap ring 81*c*, such as a ball and detent, are also contemplated as within the scope of the present invention. An O-ring 81*d* seals between the fitting 81*c* and the swivel connector 81*b* to inhibit pressurized air entering the air inlet from escaping. The snap ring 81*c* and O-ring 81*d* do not inhibit the rotation of the swivel connector 81*b* on the fitting 81*a*. An upper end of the fitting 81*a* is threaded, as is the lower internal end of the air cylinder 82. The fitting 81*a* is threaded into the lower end of the inlet cylinder 82 until a flange 81*e* of the fitting abuts the lower end of the inlet cylinder. Another O-ring 81*f* seals between the fitting 81*a* and the inlet cylinder 82 so that air flows through the inlet cylinder to the working parts of the tool. A hex-shaped keyway 82*d* is designed to receive a hex-shaped key (a fragment of which is indicated at 82*e*) for rotating the fitting 81*a* within respect to the air inlet cylinder 82, thereby engaging the threads 82*c* and threading the fitting fully into the cylinder. The keyway 82*d* and key 82*e* may be formed in any number of matching shapes (e.g., star, square, pentagon, etc.) capable of transferring force from the key to the fitting 81*a*.

Moreover, the outer layer 73 of soft material, preferably formed from rubber, is overmolded onto the grip 71 after the plastic molding process. The preferred overmolding process forms the outer layer 73 directly on the grip 71, fusing the outer layer to the surface of the grip and providing a more secure gripping surface for the user. The overmolding process essentially requires the use of a mold slightly larger than the grip 71, such that the space between the grip and the mold can receive flowable rubber material, which forms the outer layer 73 of the grip, after the rubber cures. Because the rubber outer layer 73 fuses directly to the grip 71, the layer fits snugly over the grip and requires no further retention means. The snug fit helps the outer layer 73 stay seated against the grip 71 during tool 51 use, so that the user can firmly grip the tool without movement between the grip and the outer layer.

Figure 4:
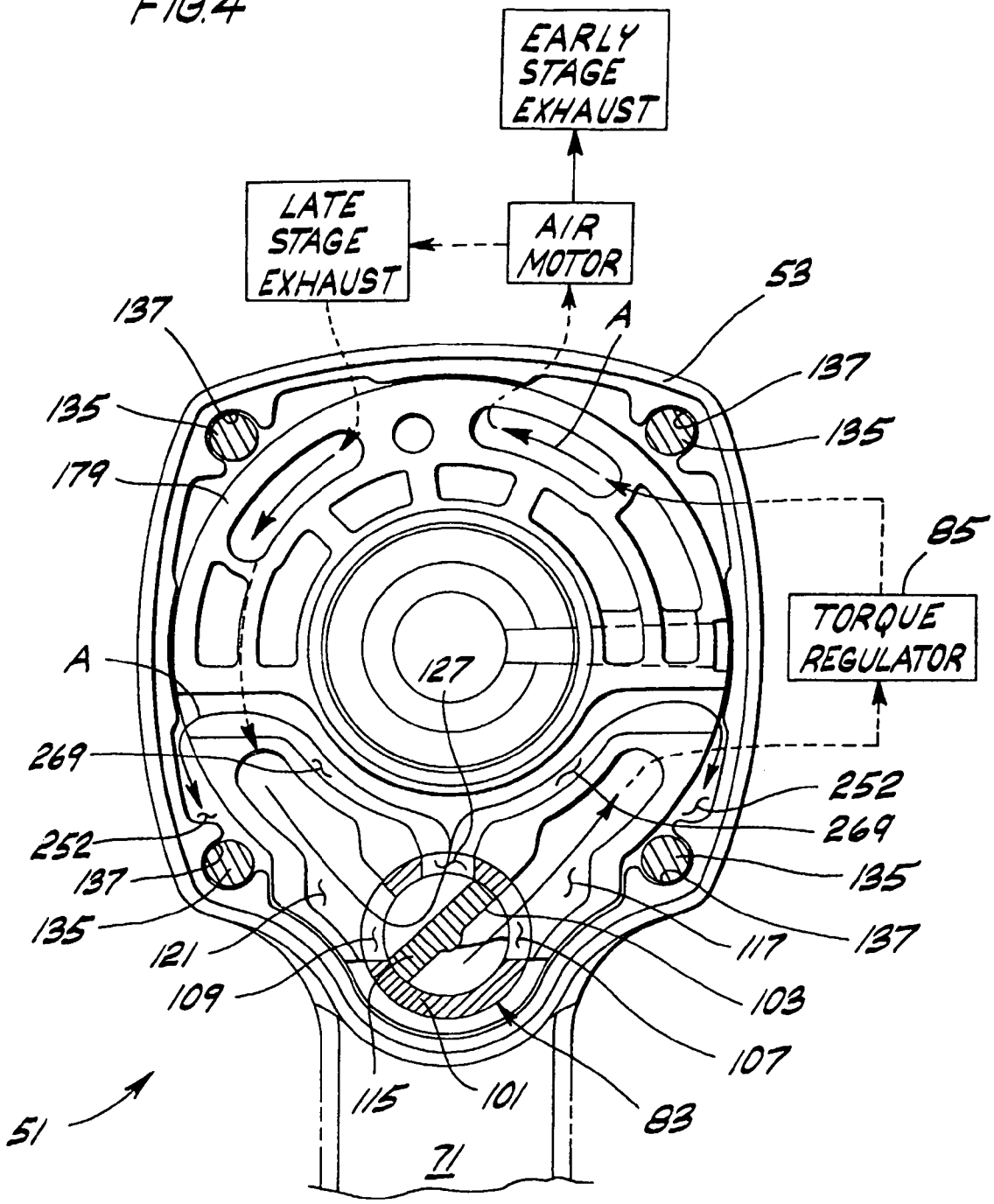
FIG. 4 is a fragmentary schematic rear elevation with an end cover of the tool removed to reveal internal construction and air flow.
Figure 6:
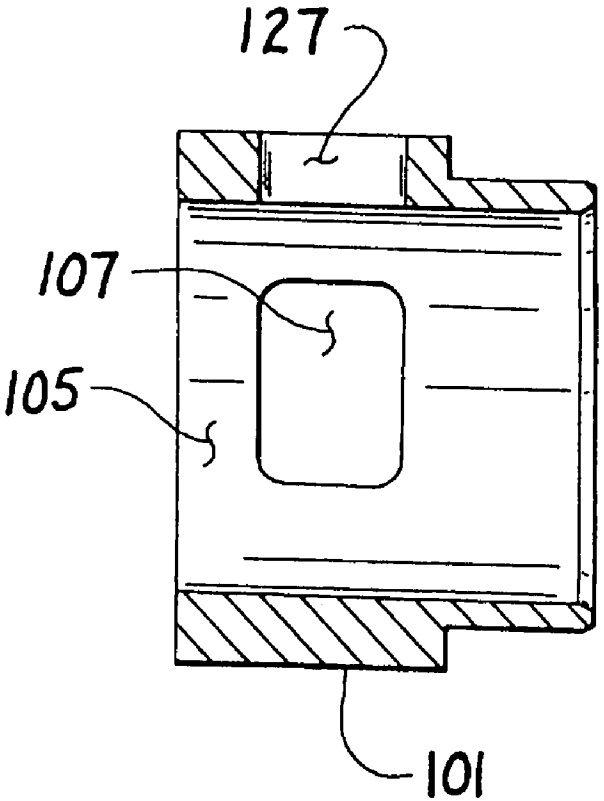
FIG. 6 is a section of the valve body taken in a plane including line 6-6 of FIG. 5.
Figure 5:
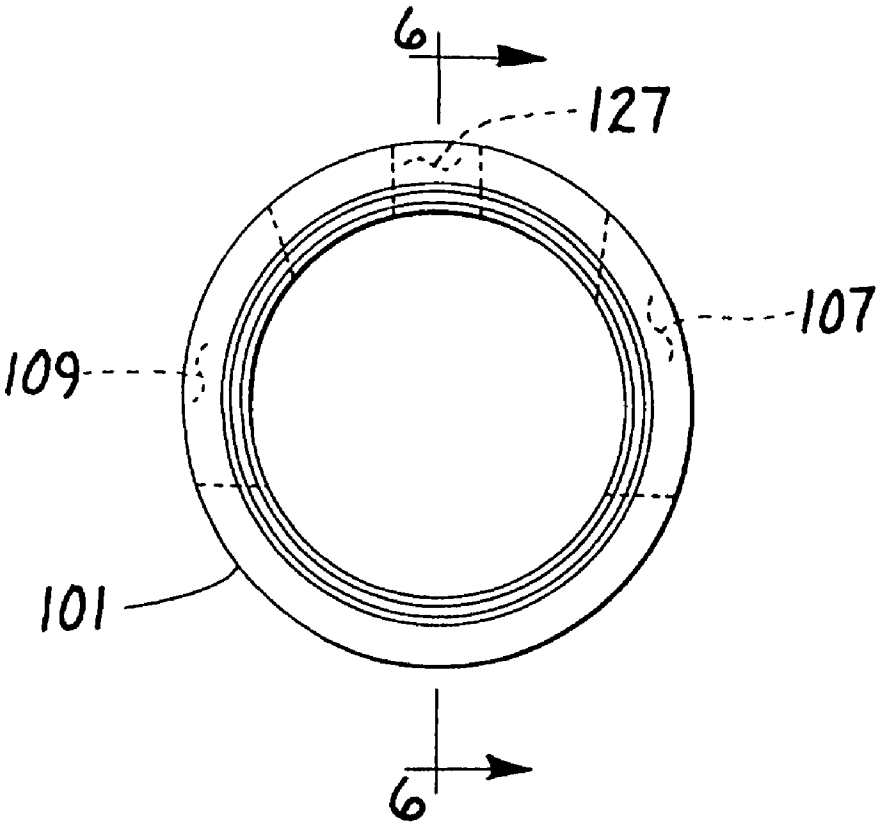
FIG. 5 is a rear elevation of a valve body.
Figure 8:
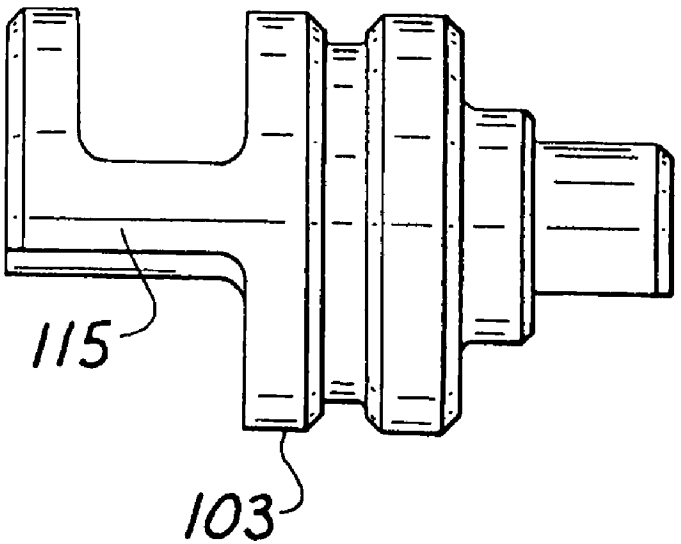
FIG. 8 is a right side elevation of the valve member of FIG. 7.
Figure 7:
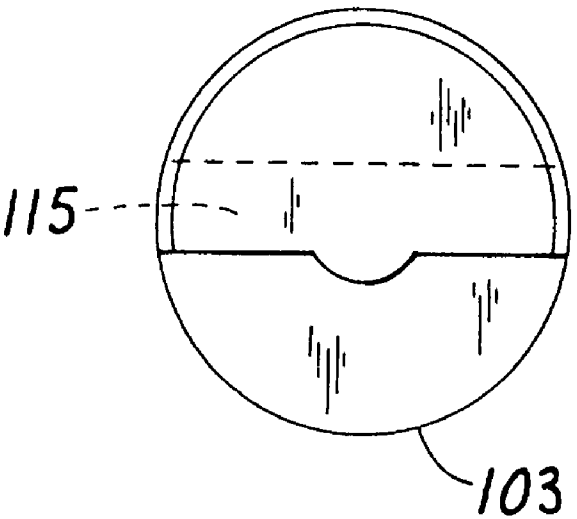
FIG. 7 is a front elevation of a valve member.

After the inlet 81, the air passes through a tilt valve 95, which can be opened by pulling the trigger 75 (FIG. 3). The detailed construction and operation of the tilt valve 95 will not be discussed here, as the design is well known in the relevant art. The air then passes through the remainder of the inlet 81 until it passes through the rotation selector valve 83 (FIGS. 3 and 4). The rotation selector valve 83 comprises two pieces, a valve body 101 (FIGS. 4, 5 and 6) fixed in position and a valve member 103 (FIGS. 7 and 8) rotatable within the valve body. The valve body 101 is cylindrical having a first open end 105 for allowing air to enter the rotation selector valve 83. The valve member 103 directs the flow of air through the valve body 101 and out through either a first side port 107 or a second side port 109. The valve member 103 has an interior plate 115 rotatable with the valve member for directing the pressurized air. Referring now to FIG. 4, when in a first position, the plate 115 directs air through the first side port 107 and into a first passage 117 for delivering air to an air motor, generally indicated at 119 (FIG. 17) (discussed below), to power the motor and drive the output shaft 57 in the forward direction. When in a second position (shown in phantom in FIG. 4), the plate 115 directs air through the second side port 109 and into a second passage 121 for delivering air to the motor 119 to power the motor and drive the output shaft 57 in the reverse direction. The valve body 101 contains an additional top port 127 which allows a secondary air flow through the valve 83 simultaneous with air flow directed through either the first or second passage 117,121. The details of the secondary air flow will be discussed below.

The pneumatic rotary tool 51 is of the variety of rotary tools known as an impact wrench. A Maurer Mechanism 131 (FIG. 3), contained within the Maurer Mechanism casing 55 and discussed below, converts high speed rotational energy of the air motor 119 into discrete, high torque moments on the output shaft 57. Because the high torque impacts are limited in duration, an operator can hold the tool 51 while imparting a larger moment on the output shaft 57 than would be possible were the high torque continually applied. Impact tools are useful for high torque applications, such as tightening or loosening a fastener requiring a high torque setting.

Figure 9:
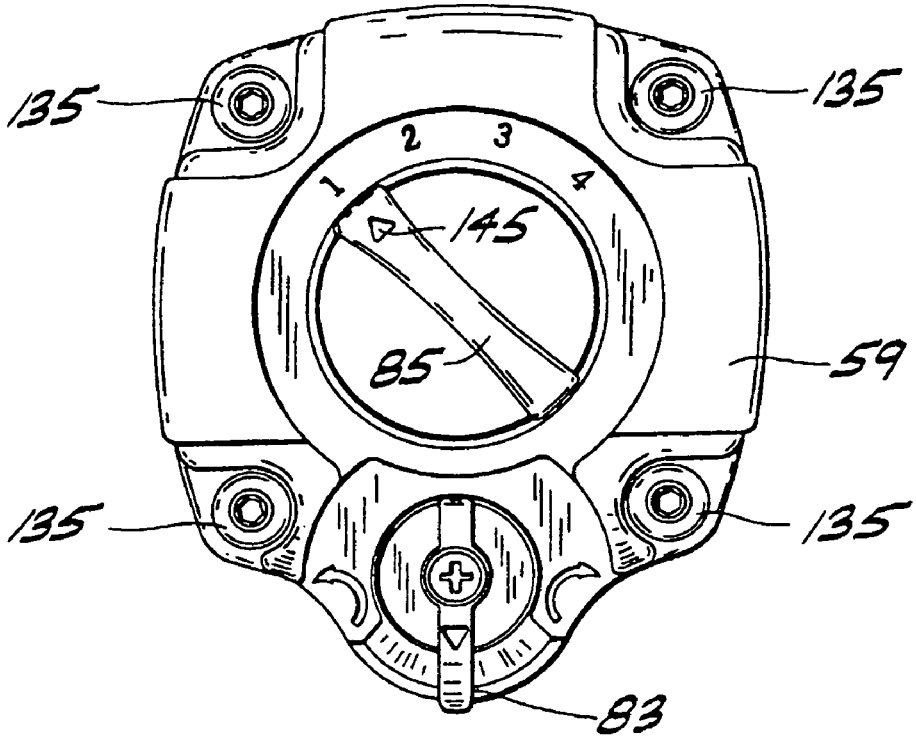
FIG. 9 is a rear elevation of the end cover with a torque selector positioned to a setting of 1.
Figure 10:
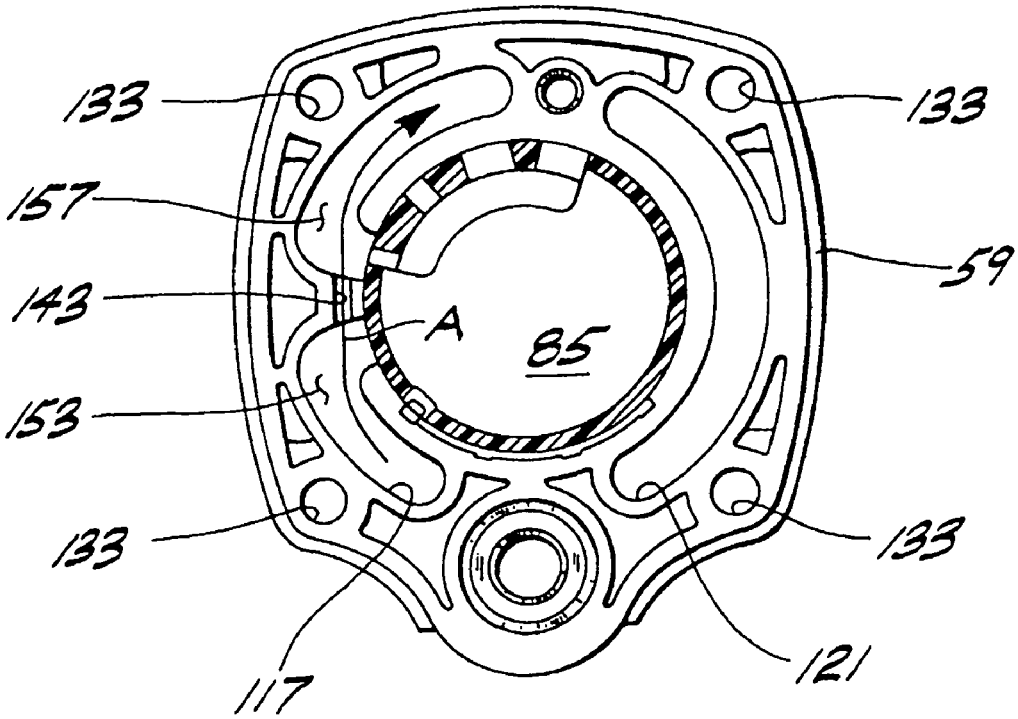
FIG. 10 is a front elevation of the end cover and partial section of the torque selector of FIG. 9.

Once the air passes through the rotation selector valve 83, the air travels through an air passage toward the air motor 119. The air passage may be configured with different passages as will now be described in greater detail. First, air passes through either the first or second passage 117,121 on its way to the air motor 119. Air directed through the first passage 117 passes through a torque selector 85 (FIG. 4). As discussed previously, the torque selector 85 controls the pressurized air, allowing the user to set a precise output torque for the tool 51. The end cover 59 mounts on the rear of the housing 53 (FIG. 3). Four bolt holes 133 formed in the end cover 59 receive threaded bolts 135 for attaching the end cover 59 and the Maurer Mechanism casing 55 to the housing 53 (FIGS. 3 and 10). The bolts 135 fit through the holes 133 in the end cover 59, pass through elongate bolt channels 137 formed within the housing 53 and fit into threaded holes (not shown) within the Maurer Mechanism casing 55, clamping the tool components together (FIGS. 2, 4 and 9). The torque selector 85 rotates within the end cover 59 between four discrete settings. FIGS. 9 and 10 show the first setting, where the flow of air through the first passage 117 is limited to air passing through a fixed orifice 143. The fixed orifice 143 has a smaller cross-sectional area than the first passage 117, throttling the air passing through the first passage. The torque selector 85 blocks any additional air from passing through the first passage 117. The first setting corresponds to the lowest torque output, because the first passage 117 allows a minimum amount of air to pass. Viewing the torque selector 85 from the rear, the arrow indicator 145 on the torque selector indicates a setting of 1.

Figure 11:
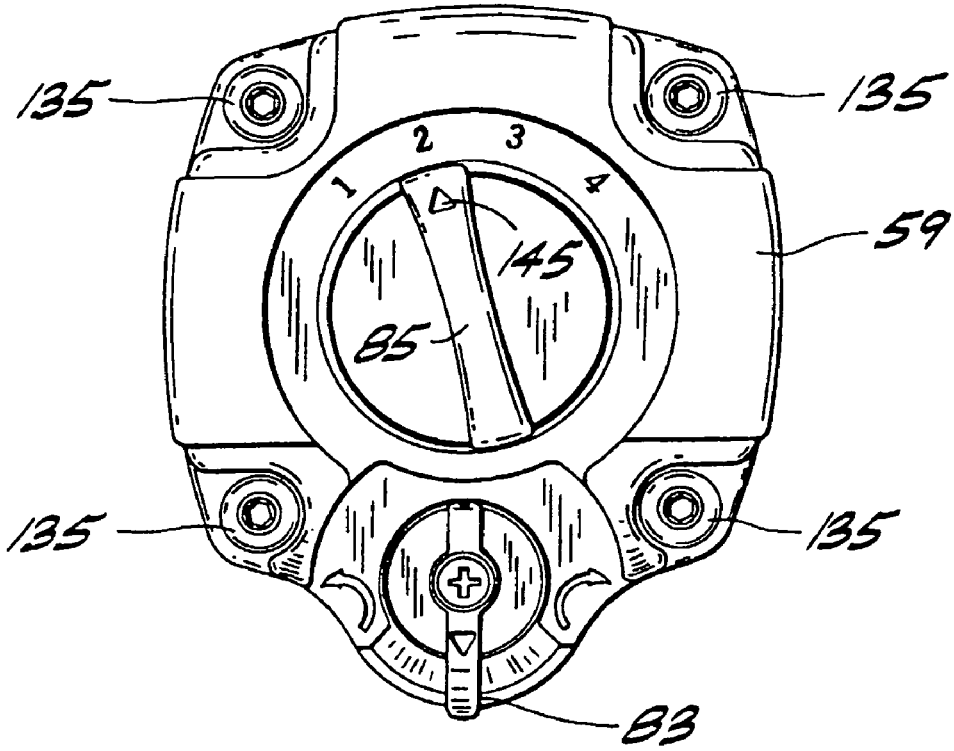
FIG. 11 is a rear elevation of the end cover with the torque selector positioned to a setting of 2.
Figure 12:
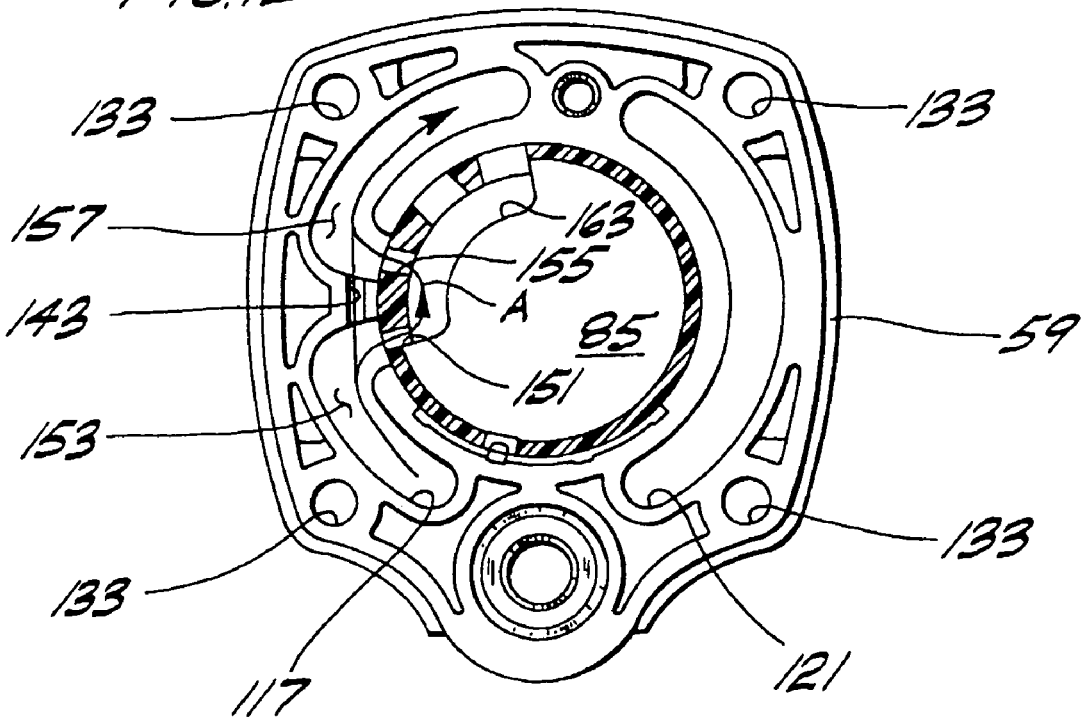
FIG. 12 is a front elevation of the end cover and partial section of the torque selector of FIG. 11.

Turning to FIGS. 11 and 12, the arrow indicator 145 indicates a setting of 2, where a first port 151 of the torque selector 85 is aligned with a lower portion 153 of the first passage 117 and a second, larger port 155 of the torque selector is aligned with an upper portion 157 of the first passage. In this configuration, some air bypasses the fixed orifice 143 and passes to the upper portion 157 of the first passage 117. More specifically, this air passes through the lower portion 153 of the first passage 117, the first port 151, a selector passage 163, the second port 155 and finally into the upper portion 157 of the first passage. At the same time, air continues to pass through the fixed orifice 143, as with the first setting. Thus, the total amount of air passing through the first passage 117 to the air motor 119 is the sum of the air passing through the torque selector 85 and the fixed orifice 143. Like the fixed orifice 143, the first port 151 controls how much air moves through the first passage 117, throttling tool power.

Figure 13:
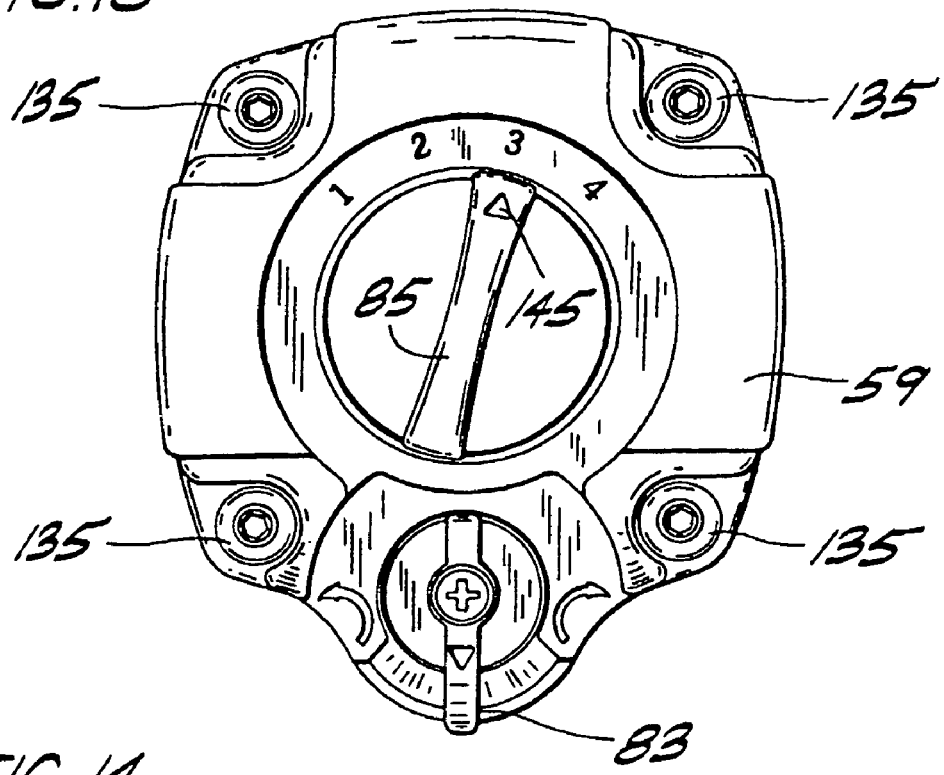
FIG. 13 is a rear elevation of the end cover with the torque selector positioned to a setting of 3.
Figure 14:
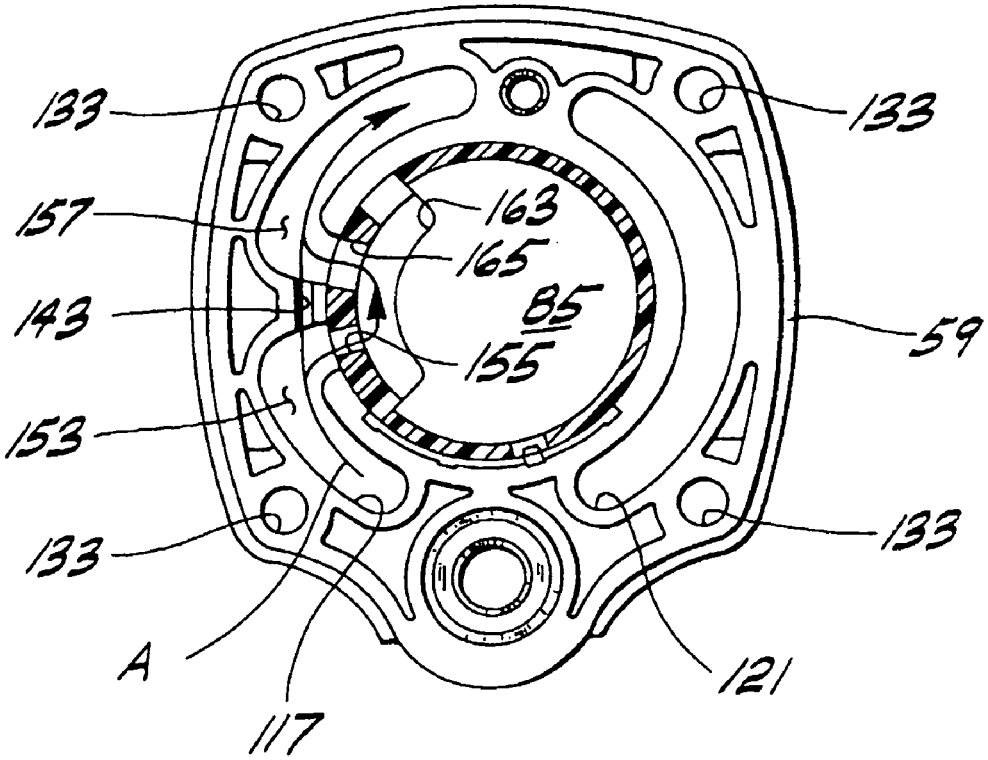
FIG. 14 is a front elevation of the end cover and partial section of the torque selector of FIG. 13.

Referring to FIGS. 13 and 14, the arrow indicator 145 indicates a setting of 3, where the second port 155 of the torque selector 85 is aligned with a lower portion 153 of the first passage 117 and a third, larger port 165 of the torque selector 85 is aligned with an upper portion 157 of the first passage. Again, the total amount of air passing through the first passage 117 is the sum of the air passing through the torque selector 85 and the fixed orifice 143. Using this selection, the sizes of the second port 155 and the fixed orifice 143 control how much air moves through the first passage 117, throttling tool power.

Figure 15:
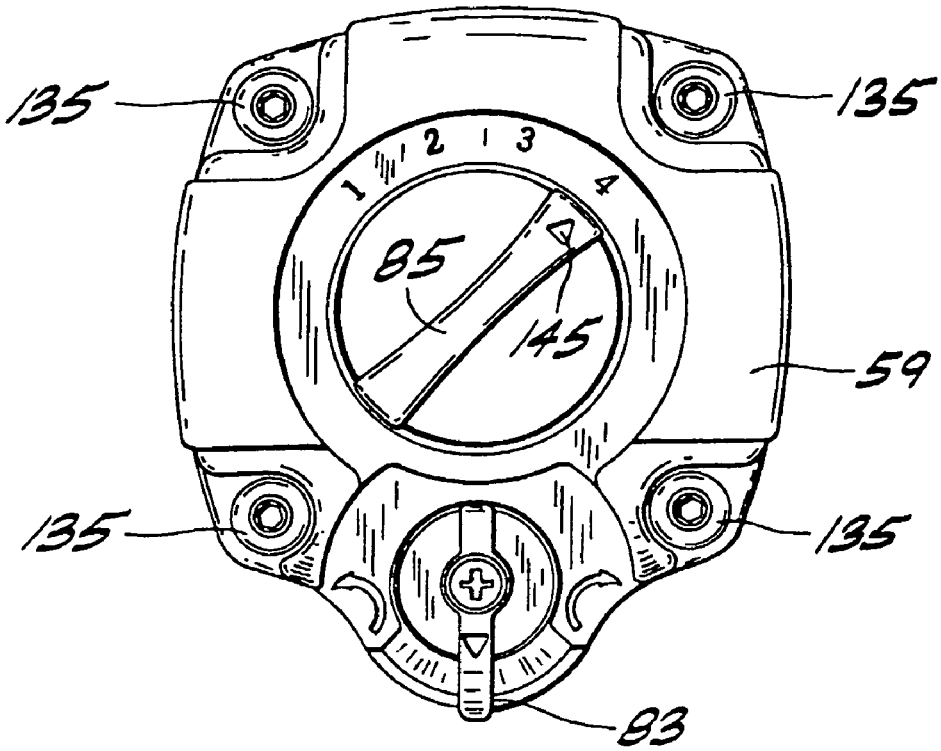
FIG. 15 is a rear elevation of the end cover with the torque selector positioned to a setting of 4.
Figure 16:
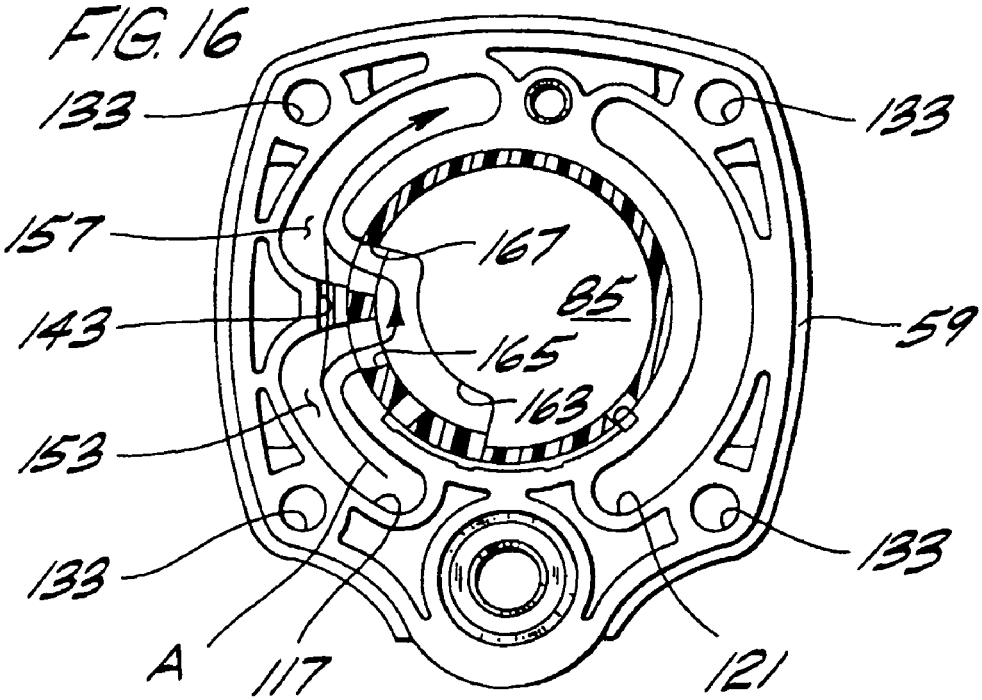
FIG. 16 is a front elevation of the end cover and partial section of the torque selector of FIG. 15.

In the final position (FIGS. 15 and 16), the arrow indicator 145 indicates a setting of 4, where the third port 165 of the torque selector 85 is aligned with a lower portion 153 of the first passage 117 and a fourth port 167 of the torque selector, identical in size to the third port, is aligned with an upper portion 157 of the first passage. The total amount of air passing through the first passage 117 is the sum of the air passing through the torque selector 85 and the fixed orifice 143. Using this selection, the size of the third port 165 and the fixed orifice 143 control how much air moves through the first passage 117, controlling tool power at a maximum allowable torque in the forward rotational direction. It is contemplated that the torque selector 85 could be formed with a fewer or greater number of ports without departing from the scope of the present invention.

Figure 17:
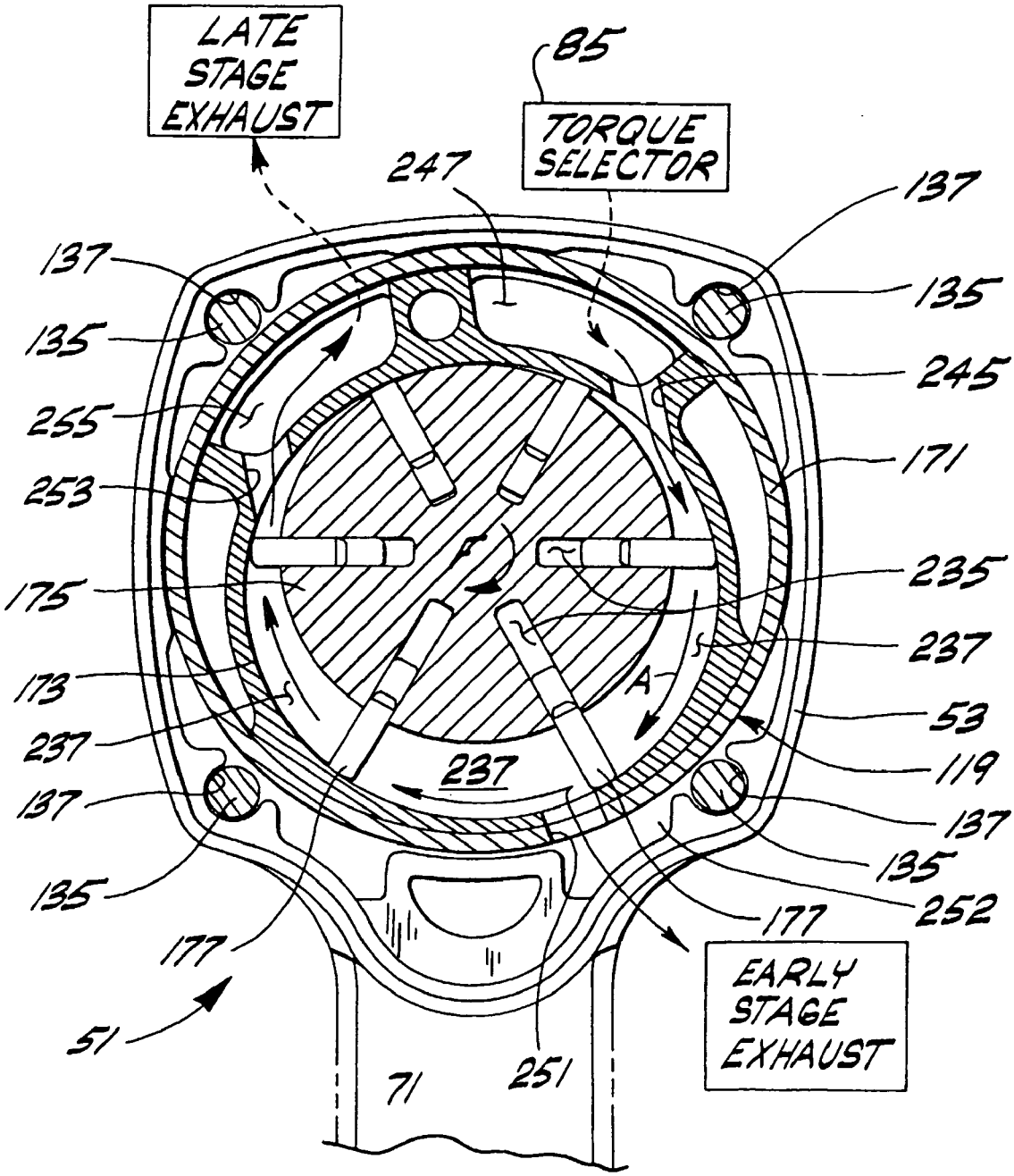
FIG. 17 is a schematic fragmentary section of the tool taken in the plane including line 17-17 of FIG. 1.
Figure 19:
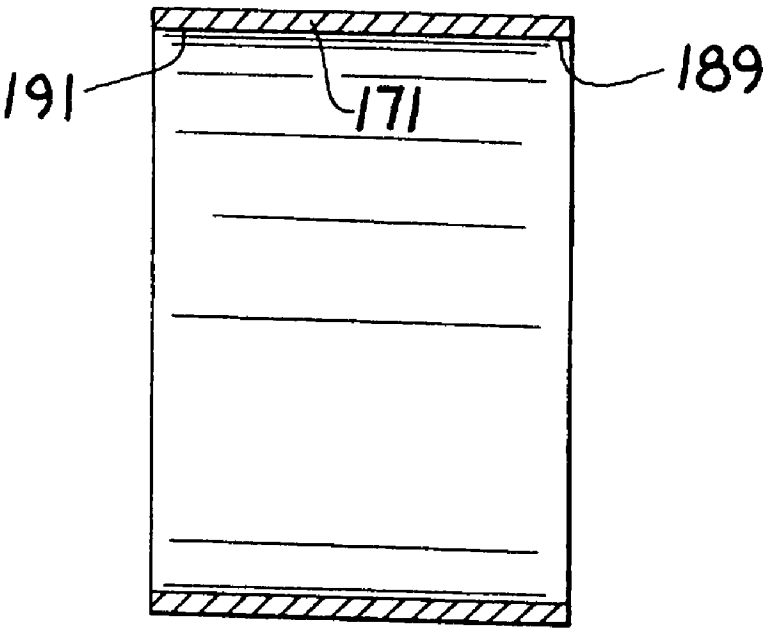
FIG. 19 is a section of the support sleeve taken in the plane including line 19-19 of FIG. 18.
Figure 18:
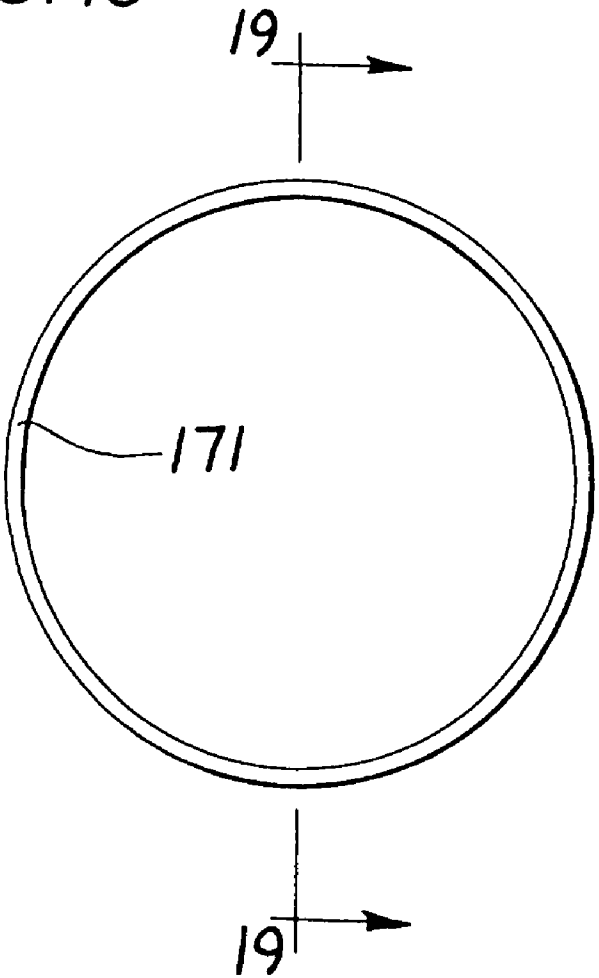
FIG. 18 is an end view of a support sleeve of the tool.
Figure 20:
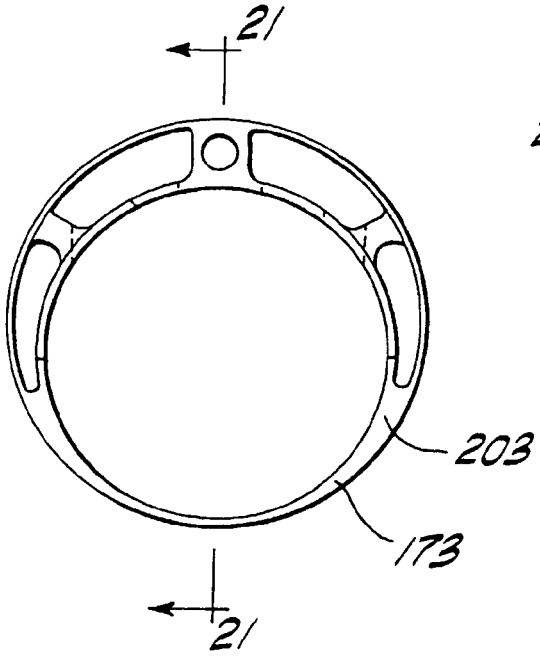
FIG. 20 is a front elevation of a passaging sleeve.
Figure 21:
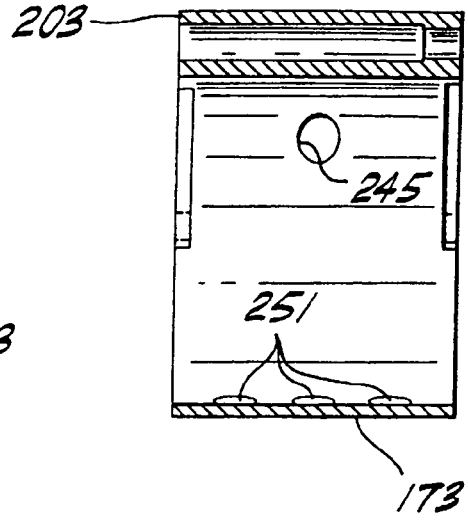
FIG. 21 is a section of the passaging sleeve taken in the plane including line 21-21 of FIG. 20.
Figure 28:
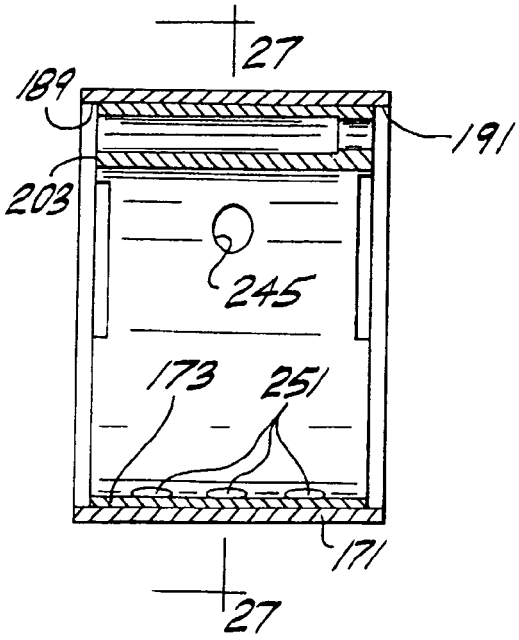
FIG. 28 is a section of the support sleeve and the passaging sleeve taken in the plane including line 28-28 of FIG. 27.
Figure 27:
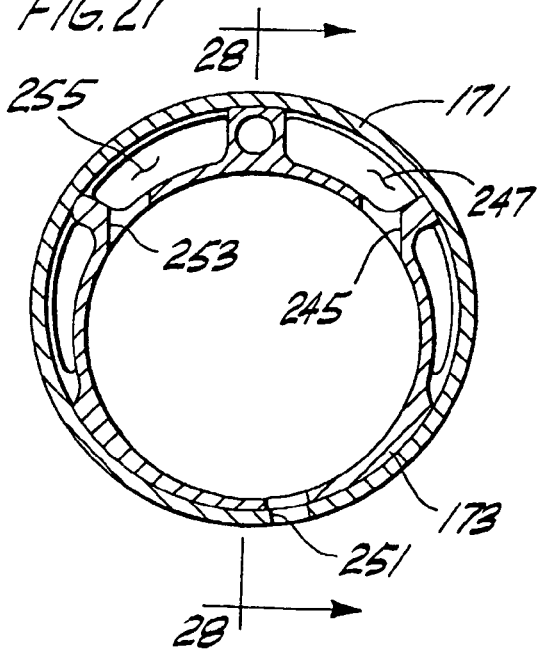
FIG. 27 is a section of the support sleeve and the passaging sleeve taken in the plane including line 27-27 of FIG. 28.

After passing through the first passage 117 and torque selector 85, the pressurized air enters the air motor 119 (FIG. 17). As best shown in FIGS. 3 and 17, the air motor 119 includes a cylindrical support sleeve 171, a passaging sleeve 173, a rotor 175 having a plurality of vanes 177, a first end cap 179 and a second end cap 181. The support sleeve 171 has a first open end 189 and a second open end 191, so that the passaging sleeve 173 mounts within the support sleeve (FIGS. 27 and 28). The first end cap 179 attaches to the first open end 189, and the second end cap 181 attaches to the second open end 191. The first and second end caps 179,181 are formed separately from the support and passaging sleeves 171,173. The end caps 179,181 and sleeves 171,173 may be economically manufactured as separate pieces. This design contrasts sharply with prior art designs incorporating cup-like motor housings that combine one end cap and the sleeve into a single part. These prior designs are more expensive to manufacture than the present invention because forming a cylinder having one end closed and machining the inside of the cylinder is more costly than forming and machining an open-ended cylinder.

In the present invention, the end caps 179,181 engage and support the support and passaging sleeves 171,179 against canting with respect to the housing 53 under forces experienced by the tool 51 in use. Three distinct shoulder connections cooperate to rigidly connect the air motor 119, the Maurer is Mechanism casing 55 and the housing 53 (FIG. 3). The first end cap 179 has a front external shoulder 193 engageable with a rear internal shoulder 195 of the Maurer Mechanism casing 55. The engagement of the shoulders 193, 195 orients the Maurer Mechanism casing 55 and the first end cap 179 so that the two are aligned along their cylindrical axes. In addition, the length of the shoulder 195 helps support the first end cap 179 within the Maurer Mechanism casing 55 to inhibit the two pieces from becoming misaligned should the tool be subjected to a large impact (e.g., if dropped). The first end cap 179 further includes a rear external shoulder 201 engageable with the support sleeve 171. The passaging sleeve 173 is shorter front to rear than the support sleeve 171 so that a front surface 203 of the passaging sleeve 173 is designed for flatwise engagement with a rear surface 205 of the first end cap 179. The support sleeve 171 extends forward beyond this surface, engaging the rear external shoulder 201 of the first end cap 179. This shoulder 201 axially aligns the first end cap 179 with the support and passaging sleeves 171,173 and inhibits misalignment of the first end cap and the sleeves. Finally, the second end cap 181 includes a front external shoulder 211 for engagement with the support sleeve 171 similar to the rear external shoulder 201 of the first end cap 179. The four bolts 135 extending from the end cover 59 to the Maurer Mechanism casing 55 compress the internal components of the tool 51, securely seating the end caps 179,181 on the support sleeve 171. The interaction of the end cover 59, housing 53, support sleeve 171, passaging sleeve 173, end caps 179,181 and Maurer Mechanism casing 55 create a closed cylinder of considerable rigidity and strength. The multiple interlocking shoulder joints and compressive forces induced by the bolts 135 inhibit the air motor 119 from canting with respect to the housing 53. The air motor 119 fits snugly within the housing 53, inhibiting it from canting with respect to the output shaft 57.

The rotor 175 is rotatable within the passaging sleeve 173 (FIGS. 3 and 17). The rotor 175 is of unitary cylindrical construction with a support shaft 213 extending from the rear end of the rotor and a splined shaft 215 extending from the front end of the rotor. The splined shaft 215 has a splined portion 221 and a smooth portion 223. The smooth portion 223 fits within a first ball bearing 225 mounted within the first end cap 179, while the splined portion 221 extends beyond the first end cap and engages the Maurer Mechanism 131. The splined portion 221 of the splined shaft 215 fits within a grooved hole 227 of the Maurer Mechanism 131 which fits within the Maurer Mechanism casing 55 (FIG. 3). The Maurer Mechanism 131 translates the high-speed rotational energy of the rotor 175 into discrete, high-impact moments on the output shaft 57. This allows the user to hold the tool 51 while the tool delivers discrete impacts of great force to the output shaft 57. The Maurer Mechanism 131 is well known to those skilled in the art, so those details will not be included here. The support shaft 213 fits within a second ball bearing 233 mounted within the second end cap 181 (FIG. 3). The splined shaft 215 and the support shaft 213 extend generally along a cylindrical axis B of the rotor 175, and the two sets of ball bearings 225,233 allow the rotor to rotate freely within the passaging sleeve 173. The axis B of the rotor 175 is located eccentrically with respect to the central axis of the passaging sleeve 173 and has a plurality of longitudinal channels 235 that receive vanes 177 (FIG. 17). The vanes 177 are formed from lightweight material and fit loosely within the channels 235, so that the end caps 179,181 and passaging sleeve 173 limit movement of the vanes 177 longitudinally of the tool within the air motor 119. The vanes 177 extend radially outwardly from the rotor 175 when it rotates, to touch the inside of the passaging sleeve 173. Adjacent vanes 177 create multiple cavities 237 within the motor 119 for receiving compressed air as the rotor 175 rotates. Each cavity 237 is defined by a leading vane 177 and a trailing vane, the leading vane leading the adjacent trailing vane as the rotor 175 rotates. As the cavities 237 pass before an inlet port 245, compressed air pushes against the leading vane 177, causing the rotor 175 to rotate.

As air travels through the air motor 119, the rotor 175 turns, causing the air cavities 237 to move through three stages: a power stage, an exhaust stage and a recovery stage (FIG. 17). Air moves from the torque selector 85 into an intake manifold 247. The pressurized air is then forced through the inlet port 245 formed in the intake manifold 247, allowing air to move into the cavity 237 between the rotor 175 and the passaging sleeve 173. This begins the power stage. As the pressurized air pushes against the leading vane 177, the force exerted on the vane causes the rotor 175 to move in the direction indicated by arrow F. As the volume of air expands in the cavity 237, the rotor 175 rotates, increasing the volume of the space between the vanes 177. The vanes continue to move outward in their channels 235, preserving a seal between the vanes and the passaging sleeve 173.

At the end of the power stage, as the volume of the cavity 237 is increasing toward its maximum amount, the leading vane 177 passes a set of early stage exhaust ports 251 in the passaging sleeve 173 and support sleeve 171 (FIGS. 17, 21, 27 and 28). These ports 251 mark the transition between the power stage and the exhaust stage, allowing expanding air to escape from inside the air motor 119 to an area of lower pressure in interstitial spaces 252 between the air motor and the housing 53. Air leaving these ports 251 is exhausted from the tool 51, as discussed below. During an early portion of the exhaust stage, the volume of the cavity 237 is larger than at any other time in the cycle, expanding to a maximum volume and then beginning to decrease as the cavity moves past the bottom of the motor 119. As the trailing vane 177 passes the early stage exhaust ports 251, some air remains within the air motor 119 ahead of the trailing vane. As the rotor 175 continues turning, the volume of the cavity 237 decreases, increasing the air pressure within the cavity. Compressing this air creates backpressure within the motor 119, robbing the spinning rotor 175 of energy, slowing the rotation of the rotor. To alleviate this backpressure buildup within the motor 119, the end of the exhaust stoke includes a late stage exhaust port 253 which allows the remaining air to escape from the air motor 119 into an exhaust manifold 255. This exhaust air is then routed out of the tool 51 as discussed below. Passing the late stage exhaust port 253 marks the transition to the third stage of the motor 119, the recovery stage, where the volume of the cavity 237 is at its smallest. This stage returns the air vane 177 to the beginning of the power stage so that the motor 119 may repeat its cycle.

Figure 24:
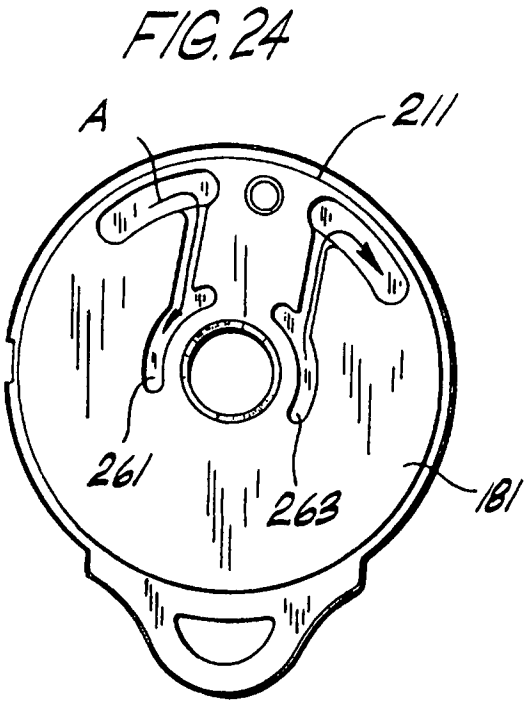
FIG. 24 is a front elevation of the first end cap.
Figure 23:
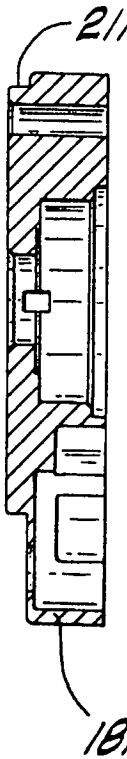
FIG. 23 is a section view of the first end cap taken in the plane including line 23-23 of FIG. 22.
Figure 22:
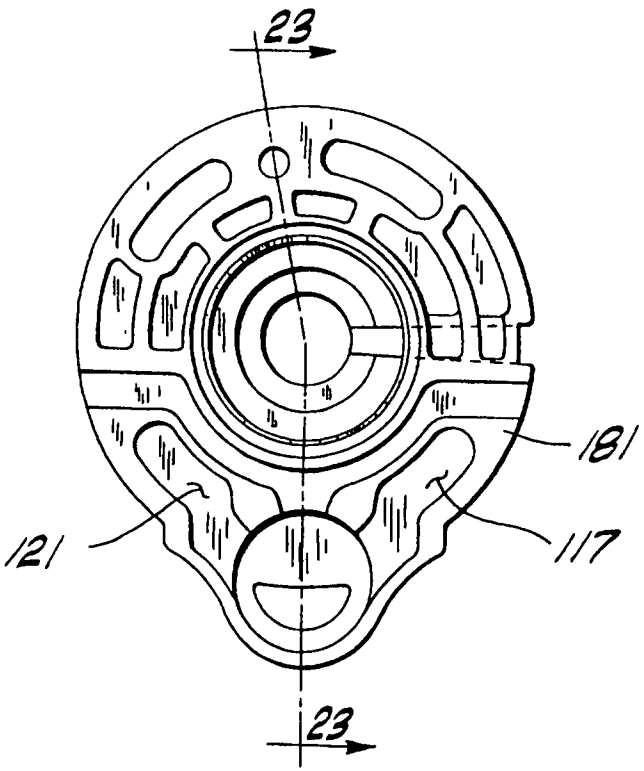
FIG. 22 is a rear elevation of a first end cap.
Figure 26:
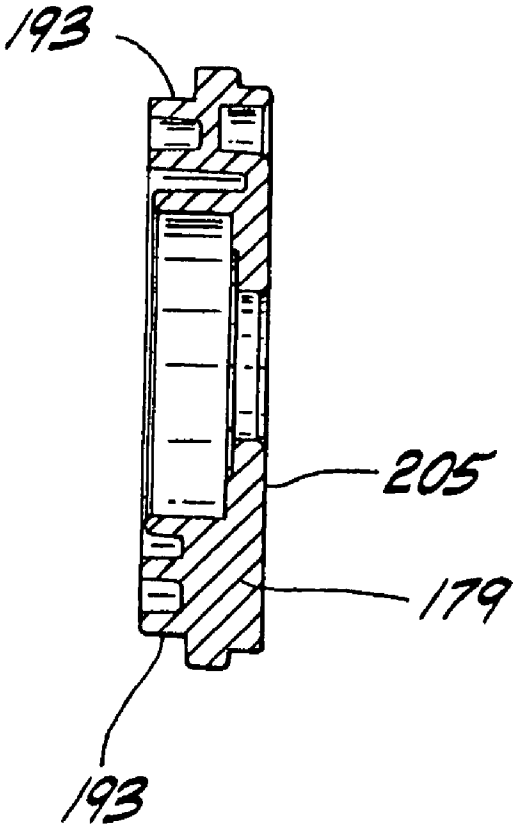
FIG. 26 is a section of the second end cap taken in the plane including line 26-26 of FIG. 25.
Figure 25:
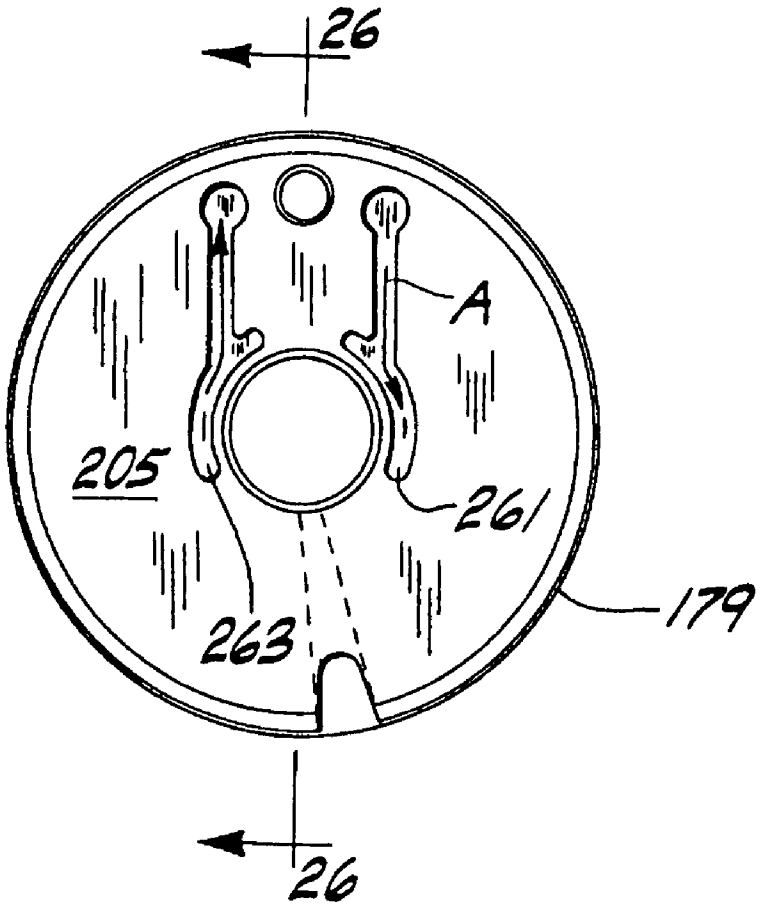
FIG. 25 is a rear elevation of a second end cap.

As the rotor 175 rotates, the vanes 177 continually move radially inward and radially outward in their channels 235, conforming to the passaging sleeve 173 (FIG. 17). The rotation of the rotor 175 forces the vanes 177 radially outward as it rotates, but the vanes may be initially reluctant to move radially outward before the rotor has begun turning at a sufficient rate to push them outward as the rotor turns. This problem may be exacerbated by the presence of required lubricants within the air motor 119. Without the vanes 177 extended from their channels 137, air may simply pass through the air motor 119 to the early stage exhaust valve 251 without turning the rotor 175 as desired. To counteract this effect, the first end cap 179 (FIGS. 25 and 26) and the second end cap 181 (FIGS. 22-24) each include a vane intake channel 261. Some pressurized air in the intake manifold 247 passes through these vane intake channels 261 at either end of the air motor 119. The air moves within the channel 261 behind the vanes 177 to push the vanes out of the channels 235 so that air passing through the motor 119 can press against the extended vanes. The vane intake channels 261 deliver air to each vane 177 as it moves through most of the power stage. The intake channel 261 ends once the vane 177 nears full extension from the channel 235. After the vane 177 begins moving back inward toward the axis of the rotor 175, the air behind the vane must escape, so vane outlet channels 263 are formed on the first end cap 179 and the second end cap 181. These allow the air behind the vane 177 to move through the channel 263 and into the exhaust manifold 255. The air may then exit the motor 119 in the same manner as the air exiting the late stage exhaust port 253.

Returning to the exhaust air exiting the early stage exhaust port 251, the air then passes through a pair of orifices (not shown) in the housing 53 which lead to the air exhaust 91 in the grip 71 (FIG. 3). Exhaust air exiting the late-stage exhaust port 253 or one of two vane outlet channels 263 and entering the exhaust manifold 255 exits the tool 51 by a different path (FIG. 4). This path guides the air through the second passage 121 back toward the rotation selector valve 83, which diverts it to two symmetrical overflow passages 269 which lead to interstitial spaces 252 between the support sleeve 171 and first end cap 179 and the housing 53 (FIG. 4). The remaining exhaust air then travels through these spaces 252 to the pair of orifices and out the air exhaust 91 as with the other exhaust air.

Operating in the reverse direction, the tool 51 works substantially the same, except that the air bypasses the torque selector 85. Air enters the tool 51 through the same air inlet 81. The rotation selector valve 83 diverts the air to the second passage 121 where the air travels upward through the tool 51 until it enters the exhaust manifold 255. The air then passes through the late-stage exhaust port 253 and enters the air motor 119 where it reacts on the opposite side of the vanes 177, thereby applying force to the rotor 175 in the opposite direction. The early-stage exhaust port 251 operates substantially the same as in the forward direction. The vane intake channel 261 and vane outlet channel 263 operate as before, except that they allow air to flow in opposite directions.

Typically, pneumatic rotary tools are almost entirely formed from a high strength metal such as steel. These tools are subjected to high stress and loading from proper use plus discrete impacts from being dropped or bumped. Although metal, such as steel, provides adequate strength, a significant drawback of an all-metal construction is the high weight and material cost. The design of the current invention eliminates these problems by forming the tool housing 53 from lightweight and inexpensive plastic. In addition, the design of the support sleeve 171 and the end caps 179,181 eliminates the need for machining expensive cup-like parts for the air motor. Such parts were a significant drawback of the prior art. The present invention employs a simple sleeve 171 and end cap 179,181 design that can withstand the impact loads of use with parts not requiring elaborate machining techniques as with the prior art. Moreover, the sleeve 171 and end cap 179,181 design is resistant to canting within the tool 51 because of the four bolts 135 and shoulder engagements between the parts.

The present invention is also directed to a method of assembling the pneumatic rotary tool 51 of the present invention. The tool 51 is designed for easy assembly according to the following method. The method described below is applicable to the tool 51 and its various parts as described above. The air motor 119 is assembled by engaging the rear external shoulder 201 of the first end cap 179 with an end of the support sleeve 171. The rotor 175 is then seated within the support sleeve 171 so that the splined shaft 215 extends outward through the first end cap 179. A plurality of vanes 177 are then inserted lengthwise into channels 235 of the rotor 175 for rotation with the rotor inside the sleeve 171. The second end cap 181 then engages the opposite end of the support sleeve 171 and the support shaft 213 for rotation of the rotor 175 within the sleeve, thereby completing construction of the air motor 119. The completed air motor 119 is then inserted into the housing 53.

The Maurer Mechanism 131 is then inserted into the Maurer Mechanism casing 55 so that the output shaft 57 of the Maurer Mechanism extends from the casing. The Maurer Mechanism casing 55 may then be engaged with the housing 53 for connection of the Maurer Mechanism 131 to the splined shaft 215 of the air motor 119. The Maurer Mechanism 131 will then rotate conjointly with the rotor 175 of the air motor 119. The end cover 59 then seats on the rear of the housing 53, thereby enclosing the air motor 119 within the tool housing.

To secure the Maurer Mechanism casing 55, housing 53 and end cover 59 together and ensure that the air motor 119 remains properly oriented within the housing, a plurality of bolts 135 are inserted through the end cover and housing. As described above, these bolts 135 thread into the Maurer Mechanism casing 55, drawing the end cover 59 toward the housing 53 and the housing toward the Maurer Mechanism casing. These bolts 135 compress the tool 51, including the end caps 179,181 and support sleeve 171 of the air motor 119 are compressed within the housing 53 to fully seat the end caps onto the support sleeve so that the motor, housing and end cover 59 cooperate to hold the air motor in proper alignment within the tool. The method described herein is preferred, although it is contemplated that the method steps may be reordered while remaining within the scope of the present invention.

The method preferably comprises another step where the housing 53 is formed by delivering flowable plastic to a mold to form the housing. The flowable plastic enters the mold and surrounds the air inlet 81 of the tool 51, creating the tool housing 53 with an air inlet cylinder having an interference fit within the housing. As discussed above, the inlet cylinder 81 allows source air to enter the tool 51 for use by the air motor 119. Other methods of forming a plastic housing 53 around an air inlet cylinder 81 are also contemplated as within the scope of the present invention. The method also preferably comprises a step of overmolding an outer layer 73 of soft material onto a portion of the housing 53 constituting a grip 71, after the step of molding the housing.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A pneumatic rotary tool comprising:
a housing;
an output shaft supported by the housing for rotation about its longitudinal axis and projecting from the housing for transmitting torque to an object;
an air motor disposed in the housing and connected to the output shaft for driving rotation of the output shaft; and
an air inlet supported by the housing and constructed for connection to a source of pressurized air for delivering pressurized air to the motor to power the motor to drive the output shaft, said air inlet further comprises an inlet cylinder, through which air passes, said housing being molded around the exterior of said inlet cylinder and holding the inlet cylinder within the housing.

2. A pneumatic rotary tool as set forth in claim 1 wherein the exterior of the inlet cylinder further comprises at least one groove for engaging a protrusion of the housing for securing the inlet cylinder within the housing.

3. A pneumatic rotary tool comprising:
a plastic housing;
an output shaft supported by the housing for rotation about its longitudinal axis and projecting from the housing for transmitting torque to an object;
an air motor disposed in the housing and connected to the output shaft for driving rotation of the output shaft; an air inlet supported by the housing and constructed for connection to a source of pressurized air;
an air passage extending from the air inlet to the motor for delivering pressurized air to the motor to power the motor to drive the output shaft; and
an air exhaust supported by the housing for exhausting air from the motor to outside the tool housing;
said air motor further comprising a cylindrical support sleeve having a first open end and a second open end, a rotor being rotatable within said support sleeve having a plurality of vanes which extend radially outwardly from the rotor when the rotor rotates, a first end cap attached to said first open end, and a second end cap attached to said second open end, the first and second end caps being formed separately from the support sleeve, each end cap comprising an annular projecting portion extending into a respective one of the open ends of the support sleeve and engaging the support sleeve at an internal diameter edge margin of the support sleeve to radially locate the end cap, and an annular flange engaging a respective one of the axial ends of the support sleeve to axially locate the end cap and support sleeve, the first and second end caps supporting the support sleeve in the housing against canting with respect to the housing under forces experienced by the tool in use.

4. A pneumatic rotary tool as set forth in claim 3 wherein the support sleeve and the end caps have a common central axis.

5. A pneumatic rotary tool as set forth in claim 4 wherein the housing further comprises a clutch casing encasing a clutch mechanism, the clutch casing having a back end engageable with the housing so that the output shaft extends from the outer end of the clutch casing.

6. A pneumatic rotary tool as set forth in claim 5 wherein the first end cap further comprises a front external shoulder for engaging a rear internal shoulder of the clutch casing for orienting the clutch casing and the first end cap so that the two are aligned along their cylindrical axes and inhibiting the clutch casing and the first end cap from becoming misaligned should the tool be subjected to an impact.

7. A pneumatic rotary tool as set forth in claim 6 further comprising a plurality of bolts extending through the housing and engaging with the clutch casing, the bolts cooperating to compress the internal components of the tool, securely seating the end caps to the support sleeve so that the engagement of the housing, support sleeve, end caps, clutch casing and bolts cooperate to form a tool of considerable rigidity and strength resistant to movement of the air motor with respect to the housing should the tool be subjected to an impact.

8. A pneumatic rotary tool as set forth in claim 3 further comprising a torque selector supported by the housing in a location for regulating flow of air through the air passage whereby selective adjustment of the torque selector changes the torque output of the motor.

9. A pneumatic rotary tool as set forth in claim 8 wherein the housing further comprises an end cover, said torque selector being rotatable within said end cover, said torque selector including a portion disposed in the air passage to regulate air flow in said air passage, said torque selector includes differently sized ports and is movable between a plurality of discrete positions, to place a different port in communication with the air passage for controlling the flow of air into the motor, thereby controlling the torque output of the motor.

10. A pneumatic rotary tool as set forth in claim 3 wherein the air motor has an early stage exhaust port for exhausting air from the motor into the air exhaust and a late stage exhaust port for releasing residual air from the motor to reduce back pressure within the air motor.

11. A pneumatic rotary tool as set forth in claim 3 wherein the air inlet further comprises an inlet cylinder, through which air passes, said housing being molded around the exterior of said inlet cylinder for holding the inlet cylinder within the housing.

12. A pneumatic rotary tool as set forth in claim 11 wherein the air inlet further comprises a fitting and a connector through which air passes, the fitting being removably threaded into the inlet cylinder.

13. A pneumatic rotary tool as set forth in claim 12 wherein the connector is mounted on the fitting for pivoting movement relative to the fitting.

14. A pneumatic rotary tool as set forth in claim 13 wherein the fitting includes a hex-shaped keyway sized and shaped for receiving a hex-shaped key for rotating the fitting within respect to the inlet cylinder, thereby engaging the threads and threading the fitting fully into the inlet cylinder.

15. A pneumatic rotary tool as set forth in claim 3 wherein the housing further comprises a grip extending downwardly from the housing, said grip further comprises an outer layer of soft material overmolded onto the grip and formed to cushion and ease pressure on the user's hand and increase friction between the grip and the user, allowing a user to grasp and hold the tool securely.

16. A pneumatic rotary tool comprising:

a housing;

an output shaft supported by the housing for rotation about its longitudinal axis and projecting from the housing for transmitting torque to an object;

an air motor disposed in the housing and connected to the output shaft for driving rotation of the output shaft in the forward and reverse directions;

an air inlet supported by the housing and constructed for connection to a source of pressurized air;

an air passage extending from the air inlet to the motor for delivering pressurized air to the motor to power the motor and drive the output shaft;

an air exhaust supported by the housing for exhausting air from the motor to outside the tool housing; and a torque selector supported by the housing in a location for regulating flow of air through the passage to the motor, said torque selector including ports of different sizes and being mounted for movement relative to the housing to bring different ones of the ports into the air passage for selectively changing the effective cross sectional area of the air passage at the location, thereby to control the flow of air and hence the torque output of the motor.

17. A pneumatic rotary tool as set forth in claim 16 wherein the ports within the torque selector are arranged in series according to size so that movement of the torque selector in one direction will increase the torque output and movement of the torque selector in the other direction will decrease torque output.

18. A pneumatic rotary tool as set forth in claim 17 wherein said ports comprise four ports of varying cross-sectional area.

19. A pneumatic rotary tool as set forth in claim 16 wherein the housing further comprises an end cover, said torque selector being rotatable within said end cover.

20. A pneumatic rotary tool as set forth in claim 19 wherein the end cover further comprises an orifice for allowing a minimum amount of pressurized air to travel through the passage irrespective of the position of the torque selector.

21. A pneumatic rotary tool as set forth in claim 20 wherein the end cover further comprises a selector passage for use in altering the effective cross-sectional area of the passage by providing another passage parallel to the orifice, thereby increasing the effective total cross-sectional area of the passage and the amount of pressurized air passing through the torque selector.

22. A pneumatic rotary tool as set forth in claim 21 wherein the torque selector is formed with ports of different size selectively positionable to permit air to enter the selector passage.

23. A pneumatic rotary tool as set forth in claim 16 wherein the air motor has an early stage exhaust port for exhausting air from the motor into the air exhaust and a late stage exhaust port for releasing residual air from the motor to reduce back pressure within the air motor.

24. A pneumatic rotary tool as set forth in claim 16 wherein said air motor further comprises a cylindrical support sleeve having a first open end and a second open end, a rotor being rotatable within said support sleeve having a plurality of vanes which extend radially outwardly from the rotor when the rotor rotates, a first end cap attached to said first open end, and a second end cap attached to said second open end, the first and second end caps being formed separately from the support sleeve, the first and second end caps engaging the support sleeve for supporting the support sleeve in the housing against canting with respect to the housing under forces experienced by the tool in use, said support sleeve and end caps being formed for radial location of the support sleeve and end caps on a common central axis.

25. A pneumatic rotary tool as set forth in claim 16 wherein the air inlet comprises an inlet cylinder, through which air passes, said housing being molded around the exterior of said inlet cylinder and holding the inlet cylinder within the housing.

26. A pneumatic rotary tool as set forth in claim 25 wherein the inlet cylinder further comprises a fitting and a connector through which air passes, the fitting being threaded into the inlet cylinder.

27. A pneumatic rotary tool as set forth in claim 26 wherein the connector is mounted on the fitting for pivoting movement relative to the fitting.

28. A pneumatic rotary tool as set forth in claim 26 wherein the fitting is capable of receiving a tool, so that the tool and fitting may rotate conjointly to thread the fitting into the inlet cylinder.

29. A pneumatic rotary tool as set forth in claim 28 wherein the fitting includes a keyway for receiving the tool.

30. A pneumatic rotary tool as set forth in claim 29 wherein the keyway is hex-shaped.

31. A pneumatic rotary tool as set forth in claim 16 wherein the housing further comprises a grip extending downwardly from the housing, said grip further comprises an outer layer of soft material overmolded onto the grip and formed to cushion and ease pressure on the user's hand and increase friction between the grip and the user, allowing a user to grasp and hold the tool securely.

32. A pneumatic rotary tool comprising:

a housing;

an output shaft supported by the housing for rotation about its longitudinal axis and projecting from the housing for transmitting torque to an object;

an air motor disposed in the housing and connected to the output shaft for driving rotation of the output shaft in the forward and reverse directions;

an air inlet supported by the housing and constructed for connection to a source of pressurized air;

an air passage extending from the air inlet to the motor for delivering pressurized air to the motor to power the motor and drive the output shaft;

an air exhaust supported by the housing for exhausting air from the motor to outside the tool housing;

a torque selector supported by the housing in a location for regulating flow of air through the passage, said torque selector being adapted to selectively change the effective cross sectional area of the air passage at the location thereby to control the flow of air and hence the torque output of the motor; and an orifice arranged relative to the air passage and the torque selector for allowing a minimum amount of pressurized air to travel through the air passage irrespective of the torque selector.

33. A rotary vane air motor for use in a pneumatic tool comprising:

a cylindrical motor housing;

a rotor rotatable within the motor housing, the rotor having a plurality of vanes which extend radially outwardly from the rotor when the rotor rotates to touch the inside of the motor housing, the vane being most forward in the direction of rotation being the leading vane and the vane immediately following being the trailing vane, wherein adjacent vanes create multiple cavities within the motor for receiving a portion of compressed air as the rotor rotates and the cavities pass before an inlet port, the compressed air pushes against the a leading vane, causing the rotor to rotate, said cavities formed between each pair of adjacent vanes may be categorized according to their position within the motor housing such that when the rotor rotates each cavity moves through a power stage, an exhaust stage and a recovery stage; and an exhaust associated with the housing and arranged to permit primary and secondary exhaust to inhibit back pressure on the trailing vane in the exhaust and recovery stage.

34. A rotary vane air motor for use in a pneumatic tool as set forth in claim 33 further comprising a first exhaust port formed in the motor housing at the beginning of the exhaust stage such that as the leading vane passes the first exhaust port the compressed air is exhausted from the motor housing after the cavity completes its power stage, leaving the air within the cavity in an uncompressed state as the trailing vane passes the first exhaust port.

35. A rotary vane air motor for use in a pneumatic tool as set forth in claim 34 further comprising a second exhaust port is formed in the motor housing at the end of the exhaust stage for exhausting the remaining air from the motor housing as the cavity passes so that as the volume of the cavity decreases, back pressure does not build up against the trailing vane, thereby decreasing the torque output of the tool.

36. A rotary vane air motor as set forth in claim 35 wherein said motor housing further comprises a cylindrical support sleeve having a first open end and a second open end, said rotor being rotatable within said support sleeve, a first end cap attached to said first open end, and a second end cap attached to said second open end, the first and second end caps being formed separately from the support sleeve, the first and second end caps engaging the support sleeve for supporting the support sleeve, said end caps each comprise an annular projecting portion extending into a respective one of the open ends of the support sleeve and engaging with the support sleeve as an internal diameter edge margin of the support sleeve to radially locate the end cap, and an annular flange engaging a respective one of the axial ends of the support sleeve to axially locate the end cap and support sleeve.

* * * * *